US007172197B2

(12) United States Patent
Wilson et al.

(10) Patent No.: US 7,172,197 B2
(45) Date of Patent: Feb. 6, 2007

(54) ENTERTAINMENT MACHINE

(75) Inventors: Richard Wilson, Notts (GB); Ian Griffiths, Notts (GB); John Laurence Wain, Cheadle Hulme (GB)

(73) Assignee: Bell-Fruit Games Limited, Nottingham (GB)

( * ) Notice: Subject to any disclaimer, the term of this patent is extended or adjusted under 35 U.S.C. 154(b) by 700 days.

(21) Appl. No.: 10/237,924

(22) Filed: Sep. 5, 2002

(65) Prior Publication Data

US 2003/0073479 A1 Apr. 17, 2003

(30) Foreign Application Priority Data

| | | |
|---|---|---|
| Sep. 7, 2001 | (GB) | 0121651.4 |
| Oct. 5, 2001 | (GB) | 0123950.8 |
| Oct. 23, 2001 | (GB) | 0125411.9 |
| Oct. 31, 2001 | (GB) | 0126096.7 |
| Nov. 9, 2001 | (GB) | 0126933.1 |
| Dec. 14, 2001 | (GB) | 0129903.1 |
| Apr. 26, 2002 | (GB) | 0209548.7 |

(51) Int. Cl.
*A63F 3/00* (2006.01)

(52) U.S. Cl. ..... 273/288

(58) Field of Classification Search ..... 463/7, 463/16, 25; 273/288, 144 R, 138.1, 138.2, 273/138.3, 138.4

See application file for complete search history.

(56) References Cited

U.S. PATENT DOCUMENTS

| | | | | |
|---|---|---|---|---|
| 4,108,430 A | | 8/1978 | Matthew et al. | 273/1 |
| 5,014,988 A | | 5/1991 | Mirando et al. | 273/125 |
| 5,445,138 A | | 8/1995 | Faith | |
| 5,553,859 A | * | 9/1996 | Kelly et al. | 273/338 |
| 5,651,546 A | | 7/1997 | Lawlor et al. | 273/118 |
| 5,667,217 A | | 9/1997 | Kelly et al. | 273/126 |
| 5,752,699 A | * | 5/1998 | Crompton et al. | 273/138.2 |
| 5,860,648 A | | 1/1999 | Petermeier et al. | 273/108.2 |
| 5,895,321 A | | 4/1999 | Gassies et al. | 463/29 |
| 6,021,949 A | | 2/2000 | Boiron | 235/492 |

FOREIGN PATENT DOCUMENTS

| | | |
|---|---|---|
| EP | 0 755 033 | 1/1997 |
| EP | 0 767 447 | 4/1997 |
| EP | 0 964 372 | 12/1999 |

(Continued)

*Primary Examiner*—Kim Nguyen
(74) *Attorney, Agent, or Firm*—Michael A. Glenn; Glenn Patent Group

(57) ABSTRACT

An entertainment machine (100), for example a pusher-type entertainment machine is provided with one or more special features. These special features may be taken from the following examples: using in the machine (100) a playing piece (40, 40*i*) for which higher awards are made when compared to other playing pieces (40, 40*i*); using in the machine(100) playing pieces (40, 40*i*) of variable appearance; using in the machine(100) playing pieces (40, 40*i*) which may be locatable within the machine(100); providing the machine (100) with a mechanism to detect when it may be unattractive to the prospective players thereof and a mechanism to allow it to introduce further playing pieces into the field of play at that time; providing the machine (100) with a payout controlling mechanism, which may be arranged to keep the percentage payout of the machine within predetermined limits; providing a prize dispenser arranged to dispense non-monetary prizes.

9 Claims, 20 Drawing Sheets

FOREIGN PATENT DOCUMENTS

| | | |
|---|---|---|
| EP | 0 964 373 | 12/1999 |
| EP | 0 965 963 | 12/1999 |
| EP | 1 310 926 | 5/2003 |
| GB | 2 250 368 | 6/1992 |
| GB | 2 303 309 | 2/1997 |
| GB | 2305866 | 4/1997 |
| GB | 2329366 | 1/1999 |
| GB | 2 363 584 | 1/2002 |
| GB | 2 378 906 | 2/2003 |
| GB | 2 379 614 | 3/2003 |
| GB | 2 380 417 | 4/2003 |
| GB | 2 381 211 | 4/2003 |
| GB | 2 381 469 | 5/2003 |
| WO | 2001/88868 | 11/2001 |
| WO | 2002/27678 | 4/2002 |

* cited by examiner

ENTERTAINMENT MACHINE

This invention relates to an entertainment machine and a method of increasing player appeal of an entertainment machine. The invention is particularly, but not exclusively, concerned with a type of entertainment machine commonly referred to as a coin pusher entertainment machine.

Traditionally such entertainment machines have one or more surfaces arranged to hold coins and a coin pusher for pushing the coins along the, or each, surface. In some embodiments coins can be pushed off an edge of the surface into a win chute to be paid directly to a player.

In use, a player inserts coins into the machine, which are deposited onto the surface in the hope that a greater number of coins are pushed from the surface by the coin pusher.

In some machines 'special' prizes, such as watches, higher value coins or notes or other valuable items, are placed upon the surface and are intended to add extra incentive for a player to play the machine. As the playing pieces on the playing surface are pushed towards the winning edge, the special prizes also progress in the same direction. The prize is paid to the player when it falls over the winning edge. Although such arrangements may provide more player appeal to players of the machine, they lead to an increased work load for the operators of the machine. The operators must ensure that the prizes are placed at positions on the playing surface that provide good player appeal.

Pusher machines are usually coin, bank note, or credit card operated and are designed to earn a profit, or to ensure that a proportion of the playing pieces are lost to the player and retained by the machine. However, the game must remain attractive to the player, who will be discouraged by a machine with a low payout rate. A suitable percentage of the monetary equivalent of the value of playing pieces introduced to the playing field should form the value of the payout. This payout percentage should allow the machine to earn a profit but will also seem reasonable to a player. The payout percentage must be selected accordingly and, ideally, maintained. The payout percentage may have to comply with relevant gaming legislation of the country in which the machine is situated.

In the past, the payout percentage of a machine has been set in various ways. For example, the losing edges have a substantially vertical wall running for a portion of their length. The length of the walls is adjustable and may be retracted to allow an increase in the length of the or each losing edge from which it is possible for a playing piece to fall and therefore allow more playing pieces to be retained by the machine. Alternatively, the walls may be lengthened for the opposite effect.

A second way in which the payout percentage has previously been affected is with a hinged lip portion along the winning edge region of the playing surface. Increasing the angle of elevation of the lip above the horizontal has the effect of forcing the playing pieces "up-hill" in order to fall from the winning edge. Under these conditions, more pieces are likely to progress towards the losing edges and be retained by the machine. Thus, increasing the angle of elevation of the hinged lip affects an decrease in payout percentage (i.e. less playing pieces fall over the winning edge, and more playing pieces fall over the or each losing edge) and decreasing the angle of elevation has the opposite effect.

Adjusting the machines is traditionally done by trial and error over a period of time during the active life of the machine. This may result in periods of time where the machine is not profitable as the payout percentage is too high and also periods of time where it has a payout percentage so low that the machine is not attractive to players. Further, the labour involved in adjusting the individual components often requires a degree of skill and, as it may involve giving the engineer access to the playing field, and thus, a degree of honesty is required from the engineer. Finally, the machine will be out of use over this time, and thus its profitability may be reduced.

A further known problem with these machines is that a person can tilt or/and shake the machines in an attempt to dislodge a number of the coins from the tray into the win hopper, which may also dislodge the special prizes. This not only causes that player to gain fraudulently but can make the machine less appealing for subsequent players; such pusher machines rely on the appeal of having a number of playing pieces which are apparently close to falling from the surface. Furthermore, dishonest maintenance staff can remove coins, and or special prizes from the machines during servicing.

One prior art coin pusher machine attempts to overcome some of these problems by having a playing piece re-circulation loop, which forms a closed loop inside the machine. Such a machine is shown in GB 2 303 309. A player inserts a coin into the machine to play and a playing piece is dispensed onto the surface from an internal store. If any playing pieces are knocked from the surface, over a win edge region, a device detects the number pushed off the surface and dispenses to the player the same number of coins from a store of coins. The playing pieces may or may not themselves be coins.

Before the advent of machines such as that shown in GB 2 303 309, coins paid in to the machine by the player were directly passed on to the playing surface, and the coins functioned as the playing pieces.

If a machine such as that shown in GB2 303 309 is used and a person tilts or shakes the machine this can be detected and any playing pieces which fall from the tray are not dispensed to the player. Therefore, extra security is provided. However, special prizes cannot be provided as the re-circulation loop cannot handle items of different shapes and sizes.

It will be appreciated that the entertainment machines must provide an incentive to a player playing the machine. There is therefore, an ongoing requirement to provide new games that increase the player appeal of the machine. The machine shown in GB 2 303 309 is aimed at making the pusher type of machine more secure, but it does not try to increase the player appeal of the machine. Indeed, it does not fundamentally change the player perception of game provided by the machine when compared to the machines that were known before its conception.

It is an object of the invention to overcome, or at least reduce, the problems of the prior art.

According to a first aspect of the invention an entertainment machine comprises a surface arranged to support one or more playing pieces including at least one or more first playing pieces and one or more second playing pieces, wherein the second playing pieces are discernible from the first playing pieces, the machine having at least one edge over which playing pieces can pass, and a playing piece detection means arranged to detect first playing pieces within playing pieces passing over the at least one edge of the surface.

An advantage of such a machine is that the machine can be arranged to perform predetermined acts when first playing pieces are detected falling from the playing surface.

Preferably, the entertainment machine may further comprise a playing piece dispensing means for dispensing playing pieces onto the surface. Such an arrangement conveniently allows playing pieces to be placed onto the surface.

The first playing pieces and the second playing pieces may be thought of as types of playing pieces. The surface may be arranged to support a plurality of other types of playing pieces in addition to the first and second playing pieces. For example the surface of the machine may be arranged to support one or more third playing pieces, one or more fourth playing pieces, one or more fifth playing pieces, etc.

The playing piece dispensing means may be arranged to dispense playing pieces onto the surface in response to a player inserting a predetermined amount of credit into the machine. The credit can be purchased by any means common in the art such as coins, tokens, credit cards, etc.

Conveniently the machine comprises a transfer means to transfer playing pieces which have passed over the at least one edge of the surface to the playing piece dispensing means. The transfer means may be a coin escalator.

The machine may further comprise a playing piece counter arranged to count playing pieces passing over the edge of the surface. In some embodiments the playing piece counter and the playing piece detection means are provided by the same means rather than separate means.

Preferably, the surface, playing piece detection means, playing piece dispensing means, playing piece counter and transfer means constitute a closed loop for re-circulating the first and second playing pieces internally within the entertainment machine. Therefore, the playing pieces are not paid directly to a player and if the machine is tilted or shaken prizes are not dispensed.

In one embodiment the entertainment machine further comprises a prize dispensing means arranged to dispense a first prize when the playing piece detection means detects a first playing piece passing over the edge of the surface. An advantage of such an arrangement is that the prize dispensing means can be arranged to dispense items other than coins, or playing pieces, and as such may provide a machine with more player appeal.

Preferably, the prize dispensing means is arranged to dispense a second prize in response to second playing pieces detected by the playing piece detector. In the preferred embodiment the prize dispensing means is arranged to dispense at least one coin for roughly each second playing piece that passes over the edge of the surface. Such an arrangement is advantageous because it allows the machine to function similarly to prior art coin pushers.

Should the surface be arranged to support types playing pieces in addition to first and second playing pieces the prize dispensing means may be arranged to dispense a prize for each of said other types of playing pieces passing over the at least one edge.

The prize dispensing means may be arranged to dispense a plurality of prizes (which are preferably coins) for each second playing piece passing over the at least one edge. In other embodiments the prize dispensing means may be arranged to dispense a prize after a plurality of second playing pieces have fallen over the at least one edge.

The prize dispensing means may or may not be arranged to dispense a prize/plurality of prizes for each/a plurality of first playing piece passing over the at least one edge.

The first and the second prizes may be dispensed by a single prize dispensing means , or may be dispensed by separate prize dispensing means. An advantage of providing them as the same prize dispensing means is that the first prize may simply be a plurality of second prizes. In one embodiment the second prize may be a coin, and the first prize may be a plurality of coins.

In one embodiment the machine is arranged such that prizes are separated from the playing pieces so that access to the prizes does not allow access to the playing pieces and preferably vice-versa. Advantageously, maintenance staff may change, add or adjust the prizes to be dispensed and not have access to the playing pieces. Therefore, dishonest maintenance staff cannot remove playing pieces and/or prizes.

In one arrangement, the prize dispenser is arranged to issue tokens as a prize. Such an arrangement is advantageous because a player can exchange the token for a variety of prizes, which may be determined at the time of exchange.

The prize dispenser may be arranged to print a ticket as a tokens. Alternatively, or additionally, the token may resemble a coin, or the like.

In alternative, or additional, embodiments the prize dispenser may be arranged to give prizes such as watches, notes, or the like.

In some embodiments the machine may be arranged to award a player with a number of points, or the like, when first and/or second playing pieces are detected passing over the at least one edge. Further, the machine may be arranged to allow a player to accumulate these points, or the like, so that they can win a larger prize. Such an arrangement is commonly referred to as a win bank.

In other embodiments, the machine may be arranged to allow a player to exchange points awarded thereto for credits for play of the game.

The playing piece detection means may be arranged to detect playing pieces passing over a win edge region of the surface. The win edge region preferably comprises a front edge region. It is traditional in coin pushers for coins falling over the front edge region of the surface to result in a win, and therefore such an arrangement is advantageous because it will be familiar to players of such machines.

The machine may also be arranged to allow playing pieces to fall over losing edge regions of the surface, in which no prize is given for playing pieces falling thereover. The losing region preferably comprises edge regions of the surface. Again, it is traditional in coin pushers for coins falling over edge regions to be lost from the game in progress, and such a machine will therefore be advantageous because it will be familiar to players of such machines.

The playing piece detection means may be arranged to monitor the colour of playing pieces passing over the edge of the surface. Such an arrangement allows first and second playing pieces of different colours to be used, which is advantageous because it will be readily apparent to a player whether or not a first playing piece is in the vicinity to the edge of the surface (and therefore may soon be forced to pass over the edge).

Alternatively, or additionally, the playing piece detection means may be arranged to detect the material from which the playing piece is made. Such an arrangement allows the first and second playing pieces to be made discernible by varying the material. Such an arrangement may provide a convenient way of detecting the first playing pieces.

The playing piece detection means may be able to detect playing pieces having roughly a predetermined metallic content.

In yet another alternative, or additional embodiment the playing piece detection means may be arranged to detect the presence of a tag within the playing pieces. In such an arrangement the tags are preferably electronic tags which may comprise inductive coils and/or integrated circuits, or the like, arranged to provide a detectable characteristic.

In yet a further additional, or alternative, embodiment the playing piece detection means may be arranged to monitor the dimensions of the playing pieces. Such an arrangement may be used to detect first playing pieces having a differing dimension to the second playing pieces.

Generally, the playing pieces will be roughly disc shaped and the playing piece detection means may be arranged to monitor any one or more of the following dimensions: diameter, depth, shape, presence of milling, presence of a groove.

The machine may be arranged to allow a plurality of players to play the machine at any one time (a multi-player game). However, in an alternative embodiment a single player machine may be provided.

According to a second aspect of the invention there is provided an entertainment machine containing at least a plurality of first and a plurality of second playing pieces discernible from one another, the machine comprising a surface arranged to support the first and second playing pieces and having an edge over which playing pieces can pass, and a playing piece detection means arranged to detect first playing pieces within playing pieces passing over the edge of the surface.

Conveniently, the first and second playing pieces have substantially the same physical dimensions. Such an arrangement is advantageous because it allows both playing pieces to be handled by the same apparatus.

Preferably, the machine comprises a closed loop allowing playing pieces to be recirculated within the machine.

The first and second playing pieces may be different colours from one another. Such an arrangement is convenient because it allows a player to readily see which playing pieces are about to pass over the edge of the surface. Generally, the first and second playing pieces will be visually discernible from one another. This is advantageous because it makes it readily apparent to a player that a playing piece of a particular type (i.e. a first or second playing piece) may soon pass over the edge of the surface. It may of course be possible to make the playing pieces substantially visually the same. Such an arrangement would provide "surprise" prizes to the player since they would not know whether or not a first playing piece were to pass over the edge.

The machine may contain at least one further type of playing pieces discernible from both the first and second playing pieces within the machine. The machine may contain a plurality of further types of playing pieces. For example the machine may contain one or more third playing pieces, maybe one or more fourth playing pieces, maybe one or more fifth playing pieces, etc.

Alternatively, or additionally, the playing pieces may be fabricated from different materials. Such an arrangement may be convenient to detect.

Conveniently, the first and second playing pieces may be fabricated from different metals. Such an arrangement may be convenient because it may be convenient to detect with a means such as in induction coil.

In yet another alternative or additional embodiment the playing pieces may have different physical dimensions. Preferably, the difference in the physical dimensions is small enough to allow the playing pieces to be handled by the same apparatus, but large enough to be detected.

In a preferred arrangement the number of second playing pieces may be greater than the number of first playing pieces, preferably significantly greater. Therefore, the prizes issued in response to the first playing pieces are won less frequently than prizes causes by the second playing pieces.

The entertainment machine may contain first playing pieces relative to the second playing pieces in roughly a ratio of 1:10 (ten times as many second playing pieces as first). In other embodiments the playing pieces may be maintained in roughly any of the following ratios: 1:5, 1:7, 1:12, 1:15, 1:20, 1:25, 1:50, or any ratio in between these. As the first playing pieces become less common relative to the second playing pieces it may be appropriate to increase the value of the prize dispensed for a first playing piece passing over the at least one edge.

According to a third aspect of the invention there is provided a method of increasing player appeal of an entertainment machine comprising the steps of providing a surface arranged to support one or more playing pieces, the surface having at least one edge over which playing pieces can pass, providing at least one or more first playing pieces and one or more second playing pieces, wherein the first playing pieces are discernible from the second playing pieces and the method comprising detecting the first playing pieces within the playing pieces passing over the at least one edge of the surface.

Thus, the entertainment machine increases player appeal by detecting when a first playing piece has passed over the edge of the surface and the machine can dispense a prize associated with the detection. The value of the prize may be arranged to be worth more than the cost associated with causing a single playing piece to be added to the surface and therefore, the appeal of the entertainment machine may be increased.

In one arrangement the method may further comprise the steps of transferring the playing pieces that have passed over the at least one edge of the surface to a playing piece dispensing means arranged to dispense playing pieces onto the surface.

Conveniently, the first and second playing pieces are arranged to have substantially the same dimensions. Such an arrangement is convenient because it allows both to be handled by the same apparatus.

Preferably, the method may further comprise the steps of dispensing a first prize when a first playing piece is detected passing over the at least one edge of the surface.

In a preferred embodiment the method causes the playing pieces capable of resting on the surface to be recirculated within a closed loop.

The method may provide further types of playing pieces in addition to the first and second playing pieces. Such an arrangement may allow a predetermined level of prize to be presented to a player for each type of playing piece passing over the edge of the surface.

According to a fourth aspect of the invention there is provided an entertainment machine arranged to provide a game involving one or more playing pieces wherein the machine is provided with an appearance controlling means arranged to control the appearance of at least one variable appearance playing piece within the machine.

Varying the visual appearance of playing pieces during a game is advantageous because it may increase the player appeal of the machine. Further, the visual appearance of the playing piece may be used to convey information about the playing piece to a player, such as its value, which can be used to enhance the game.

The machine may comprise a pusher type machine arranged to contain a plurality of playing pieces provided on a surface, or playing field, arranged such that playing pieces are periodically caused to fall from the playing field. However, in alternative embodiments the machine may comprise any other type of entertainment machine. For example the machine may be any one or more of the following types of machine: a pinball machine, or the like.

Preferably, the entertainment machine may comprise a playing piece dispensing means for dispensing playing pieces onto the surface. Such an arrangement conveniently allows playing pieces to be placed onto the surface.

The playing piece dispensing means may be arranged to dispense playing pieces onto the playing field in response to a player inserting a predetermined amount of credit into the machine. The credit can be purchased by any means common in the art such as coins, tokens, credit cards, etc.

Conveniently the machine comprises a transfer means to transfer playing pieces which have passed over the at least one edge of the surface to the playing piece dispensing means. The transfer means may be an escalator such as a coin escalator.

The machine may further comprise a playing piece counter arranged to count playing pieces passing over the edge of the surface.

Preferably, the surface, playing piece dispensing means, playing piece counter and transfer means constitute a closed loop for re-circulating playing pieces internally within the entertainment machine. Therefore, the playing pieces are not paid directly to a player and if the machine is tilted or shaken prizes are not dispensed.

In one embodiment the appearance controlling means may comprise one or more transmitters, which are preferably arranged to transmit a radio signal.

Further, the appearance controlling means may comprise one or more receivers arranged to receive signals generated by playing pieces within the machine.

In alternative embodiments the appearance controlling means may comprise one or more electromagnetic radiation sources arranged to transmit electromagnetic radiation such that it is incident on one or more playing pieces within the machine.

The, or each, electromagnetic radiation source may be a source of visible light. Each light source may be arranged to transmit light of substantially a single colour, or may be of a plurality of substantially single colours. In some embodiments, if a plurality of light sources is provided they may be arranged to transmit light of a variety of substantially single colours.

In an additional, or alternative, embodiment, the electromagnetic radiation source may be a source of UV light, or anther type of electromagnetic radiation.

In further embodiments, the appearance controlling means may comprise one or more heating devices arranged to emit heat such that it changes the temperature of one or more playing pieces within the machine.

The playing field of the machine may have a plurality of regions defined thereon, each arranged to alter the visual appearance of playing pieces capable of having their appearance changed passing thereover in a manner distinct to that region. Such an arrangement provides the possibility of providing different regions, which alter the appearance of playing pieces passing thereover in different ways, which may be utilised in any game provided by the machine.

Alternatively, the visual appearance of the playing pieces may be altered in an area of the machine other than on the playing field.

According to a fifth aspect of the invention there is provided a combination of an entertainment machine and one or more playing pieces, including at least one variable appearance playing piece, wherein machine is provided with an appearance controlling means arranged to cause the at least one variable appearance playing piece to alter its visual appearance.

This alteration will preferably be visible from all viewing angles, or the most likely viewing angles.

One or more of the playing pieces may be arranged to emit and/or transmit and/or reflect electromagnetic radiation, which is preferably light. Such an arrangement may be visually striking, especially in low light ambient light environments, which is typical of the environments in which an entertainment machine may be placed.

The colour of one or more of the variable appearance playing pieces may be arranged to change. Such an arrangement is advantageous because it is readily discernible by a player.

Alternatively, or additionally, one or more of the variable appearance playing pieces may be arranged to flash. The rate of the flashing may be controllable.

Alternatively, or additionally, one or more of the variable appearance playing pieces may be arranged to change shape.

Generally, the machine will include a plurality of playing pieces. Only a portion of these playing pieces may be variable appearance playing pieces. An advantage of such an arrangement is that the game provided by the machine can attach different importance to the pieces that can have their appearance changed compared to those which cannot. A further advantage may be to use the state of their variable appearance as a visual indicator of their playing pieces' value, which may change.

The entertainment machine may contain variable appearance playing pieces relative to non variable appearance playing pieces in roughly a ratio of 1:10 (ten times as many non variable playing pieces as variable playing pieces).

In other embodiments the playing pieces may be maintained in roughly any of the following ratios: 1:5, 1:7, 1:12, 1:15, 1:20, 1:25, 1:50, or any ratio in between these.

It will be appreciated that in entertainment machines, such as pushers, in which a number of playing pieces are used, that the playing pieces may stack on top of one another. Therefore, playing pieces, which are of non-variable appearance may be made transparent, and/or translucent to allow the varying display of variable display playing pieces to be seen through a stack of playing pieces.

The, or each, variable appearance playing piece may contain electronics arranged to alter the visual appearance of the playing piece. In the preferred embodiment the electronics comprises a Radio Frequency identity (RFID) tag. In such an embodiment the appearance controlling means may comprise radio frequency circuitry capable of communicating with the electronics within the playing piece. However, it will be appreciated that it would be possible to power the electronics by other means, such as batteries, solar cells, etc.

The variable appearance playing piece may include an LED preferably controlled by the electronics. Such an arrangement is capable of changing the visual appearance of the LED by controlling whether or not the LED emits light. Each playing piece may include a plurality of LED's, and each LED within a playing piece may be arranged to be illuminated in a different manner to other LED's within the playing piece.

Other light emitting sources such as lamps, etc. may also be provided within the playing piece.

Alternatively, or additionally, the variable playing piece may include any one or more of the following: a seven segment display, a Liquid Crystal Display (LCD) or any other electronically controlled display means, preferably controlled by the electronics.

Conveniently the variable appearance playing piece may be individually addressable by the appearance controlling means. Such an arrangement is advantageous because it allows variable appearance playing pieces to be controlled independently of each other.

The electronics within the variable appearance playing piece may be capable of transmitting a signal receivable by the appearance controlling means.

The appearance controlling means may comprise a plurality of receivers capable of receiving signals transmitted by the or each variable appearance playing piece. Providing a plurality of receivers is advantageous for at least two reasons: firstly, it may be used to increase the area that can receive a signal from a single variable appearance playing piece; and secondly it may allow positional information to determined for a variable appearance playing piece emitting a signal.

In some embodiments the appearance controlling means may be arranged to track the position of one or more of the variable appearance playing pieces.

Such an arrangement is convenient because it allows the game provided by the machine to be effected by the position of the or each variable appearance playing piece which is having its appearance tracked.

Alternatively, or additionally, the or each, variable appearance playing piece may comprise a transparent, and/or reflective, and/or translucent region. Indeed, the variable appearance playing piece may be substantially completely made from a transparent, and/or reflective and/or translucent material.

The appearance controlling means may comprise a light emitter. The machine may be arranged to allow the variable appearance playing pieces to pass adjacent to the controlling means such that the light emitted by the emitter passes through, or is reflected by, the variable appearance playing piece.

A plurality of light emitters may be provided of different colours, such that as variable appearance playing pieces pass adjacent different emitters the light passing through, or reflected by, the or each playing piece changes colour. Such an arrangement provides playing pieces that are different colours in different parts of the machine.

In a further embodiment the variable appearance playing pieces may comprise a portion arranged to emit light, or fluoresce when exposed to a source of electromagnetic radiation. In particular the electromagnetic radiation may be UV light.

In a further embodiment, the variable appearance playing piece may comprise a heat sensitive portion or coating, which changes colour, shape or otherwise alters in appearance in response to the temperature of its environment. The appearance controlling means may be a heating device. The machine may be arranged to allow the variable appearance playing pieces to pass adjacent to the appearance controlling means such that the heat emitted by the heating device causes the variable appearance playing piece to vary in appearance.

In an additional embodiment, the variable appearance playing piece may consist of a material which will, when subjected to predetermined conditions, change its appearance and maintain that appearance permanently, or until subjected to other predetermined conditions, or may gradually revert to its original state.

The appearance controlling means may provide these predetermined conditions. The machine may be arranged to allow the variable appearance playing piece to pass through, or collect in, a region in which the predetermined conditions are created.

In some embodiments the machine may be arranged to provide a game having an outcome dependent upon the position of the, or each, variable appearance playing piece within the machine. For example variable appearance playing pieces may score more highly in some regions of the game when compared to others. The different scoring regions may be denoted by any one or more of the following: a different colour emitted and/or transmitted by the playing piece; flashing; rate of flashing; pattern of flashing, or any other visibly discernible means.

The machine may comprise a pusher type machine arranged to contain a plurality of playing pieces provided on a surface, or playing field, arranged such that playing pieces are periodically caused to fall from the playing field.

Preferably, the entertainment machine may comprise a playing piece dispensing means for dispensing playing pieces onto the surface. Such an arrangement conveniently allows playing pieces to be placed onto the surface.

The playing piece dispensing means may be arranged to dispense playing pieces onto the surface in response to a player inserting a predetermined amount of credit into the machine. The credit can be purchased by any means common in the art such as coins, tokens, credit cards, etc.

Conveniently the machine comprises a transfer means to transfer playing pieces which have passed over the at least one edge of the surface to the playing piece dispensing means. The transfer means may be an escalator, such as a coin escalator.

The machine may further comprise a playing piece counter arranged to count playing pieces passing over the edge of the surface.

Preferably, the surface, playing piece dispensing means, playing piece counter and transfer means constitute a closed loop for re-circulating playing pieces internally within the entertainment machine. Therefore, the playing pieces are not paid directly to a player and if the machine is tilted or shaken prizes are not dispensed.

A playing piece detection means may be arranged to detect playing pieces passing over a win edge region of the surface. The win edge region preferably comprises a front edge region. It is traditional in coin pushers for coins falling over the front edge region of the surface to result in a win, and therefore such an arrangement is advantageous because it will be familiar to players of such machines. (The playing piece detection means may or may not be the same as the playing piece counter).

The machine may also be arranged to allow playing pieces to fall over losing edge regions of the surface, in which no prize is given for playing pieces falling thereover. The losing region preferably comprises edge regions of the surface. Again, it is traditional in coin pushers for coins falling over edge regions to be lost from the game in progress, and such a machine will therefore be advantageous because it will be familiar to players of such machines.

Generally, the playing pieces will be roughly disc shaped, but may be spherical, or any other shape or of variable shape and the playing piece detection means may be arranged to monitor any one or more of the following dimensions: diameter, depth, shape, presence of milling, presence of a groove.

The machine may be arranged to allow a plurality of players to play the machine at any one time (a multi-player game). However, in an alternative embodiment a single player machine may be provided.

In alternative embodiments the machine may be any other form of entertainment machine. The machine may be a machine such as a pinball machine or the like.

According to a sixth aspect of the machine there is provided a variable display playing piece that is capable of having its visual appearance altered for use in an entertainment machine.

Most preferably, the alteration shall be visible from all viewing angles, or preferably from all likely viewing angles.

In the preferred embodiment the playing piece includes a Radio Frequency Identification Device (RFID).

The visual display playing piece may include an LED and a power source. The power source may be electromagnetic induction or may be another means such as a battery, a solar cell, or other similar means.

The machine may be arranged to charge the, or each, visual display playing piece in a charging region of the machine, different to a region of the machine in which the playing piece can be viewed by a user. The machine may utilise HDX technology provided by Texas Instruments.

According to a seventh aspect of the invention there is provided a method of increasing the player appeal of an entertainment machine comprising causing at least one variable appearance playing piece provided within the machine to change its visual appearance.

Such a method may increase the player appeal of a game provided by the machine, allowing game features to be introduced based upon the appearance of the at least one playing piece.

According to a eighth aspect of the invention, there is provided a playing piece for use in an entertainment machine that is capable of producing a sound.

According to a ninth aspect of the invention there is provided an entertainment machine playing piece for use in an entertainment machine, said playing piece being provided with an identifier providing the playing piece with an identity.

Such an arrangement is advantageous because it can allow that particular playing piece to be identified from other playing pieces. Such identification may be used to increase the security of a game in which the playing piece is used, or may be used to provide unique game features, etc., which will become apparent from the following. In some embodiments such a playing piece may be used to confirm the identity of a prize paid to a player.

The identifier used on the playing piece may be unique. However, the identifier is preferably unique between playing pieces contained in any one entertainment machine. Providing such an identifier is advantageous because it can allow any one playing piece (within one machine at least) to be tracked, have its identity confirmed, etc.

In a preferred embodiment the identifier comprises an electronically readable device, which can preferably be read remotely from the playing piece. Such an arrangement is advantageous because it allows the identity of the playing piece to be ascertained, without contacting the playing piece. The electronically readable device may transmit its own signal, or be interrogated by a remote signal.

In one particular embodiment the identifier comprises a Radio Frequency Identity Device (RFID), which uses well known technology to inductively couple power from a magnetic field applied to the playing piece. Such an RFID device comprises an inductor in which current is induced by the applied magnetic field, and said current can be used to power electronics associated with the playing piece. Examples of suppliers for RFID devices include Destron Fearing, Temic, Texas Instruments, etc.

Alternatively, or additionally, a power source such as a battery, solar cell, or the like may be provided to power the playing piece.

The playing piece may comprise a memory, which may comprise a register or the like. The memory may be arranged to hold a data appertaining to the playing piece in which the memory is provided. For example the memory may be arranged to hold the value assigned to that playing piece.

Conveniently, the memory can be written to, and the data held therein may be alterable. Such an arrangement is convenient because it can, for example, allow the value of a playing piece to be varied, by the electronics within the playing piece writing to the memory.

A memory to which data can be written may be in addition to a memory, or register or the like, holding the identity of the playing piece, which is preferably read only. It is advantageous if the identity given to a playing piece is permanent, and cannot be altered.

Some embodiments of the playing piece may include an information generating means, arranged to generate information perceivable by a player of a machine in which the playing piece is being used. Such an arrangement is useful because it may for instance be used to display information such as value of the token to a player.

The information generating means may comprise any one or more of the following: LED, seven segment display (which may be LED, or LCD based), LCD, or other such, display, buzzer. An LED may be used to change the colour of a playing piece, or to cause it to illuminate. A seven segment display and/or LCD display may be used to display text and/or numbers to a player. A display may be able to display other information, such as graphics, symbols, etc., to a player. A buzzer may be caused to play sounds, jingles, etc. that may be used to convey information to a player.

Preferably, the playing piece is arranged to transmit a signal, which preferably contains data corresponding to its identifier. For example the data corresponding to the identifier may comprise a number, or may be a group of alphanumeric characters, etc. An advantage of such a playing piece is that it can allow the playing piece to be read remotely.

In alternative embodiments the identifier may comprise any other form of identifier, which is preferably machine-readable. For example the identifier may be a bar code, or the like, applied to the surface of the playing piece. A bar code scanner may read such a bar code. Alternatively, the identifier may comprise a magnetic region containing data that can be read.

According to a tenth aspect of the invention there is provided a group of playing pieces according to the ninth aspect of the invention, with each playing piece have a different identifier.

The group of playing pieces may additionally contain a plurality of playing pieces with no identifier.

The group may contain playing pieces containing identifiers relative to playing pieces without identifiers in roughly a ratio of 1:10 (ten times as many playing pieces without identifiers as playing pieces with identifiers). In other embodiments the playing pieces may be maintained in roughly any of the following ratios: 1:5, 1:7, 1:12, 1:15, 1:20, 1:25, 1:50, or any ratio in between these.

According to a eleventh aspect of the invention there is provided the combination of at least one entertainment machine playing piece being provided with an identifier providing the playing piece with an identity, and an entertainment machine containing at least one such entertainment machine playing piece, said machine being provider with a reader capable of reading the identifier provided on the playing piece.

The reader may comprise at least one receiver, capable of receiving a signal transmitted by the at least one playing piece. The reader is preferably capable of receiving an electromagnetic signal.

Preferably, the reader comprises a plurality of receivers, and more preferably, at least three receivers. Such an arrangement is advantageous because it allows positional information to determined for the playing piece that transmitted the signal. Indeed, if three, or more, receivers are provided the machine may be able to determine roughly the exact position of a playing piece.

The entertainment machine may be arranged to provide a game which is influenced by the position of one or more playing pieces. For example, the position of playing pieces on a playing field may determine their value. In one particular embodiment the playing pieces are arranged to generate information perceivable by a user to indicate the value of the playing piece.

The, or each, playing piece may have any one, or more, of the features discussed in relation to the ninth aspect of the invention.

In alternative, or additional, embodiments the reader may comprise a bar code reader, a microphone, a camera, or any other suitable means for reading an identifier provided on a playing piece.

The machine may comprise a pusher type machine arranged to contain a plurality of playing pieces provided on a surface, or playing field, arranged such that playing pieces are periodically caused to fall from the playing field.

Preferably, the entertainment machine may comprise a playing piece dispensing means for dispensing playing pieces onto the surface. Such an arrangement conveniently allows playing pieces to be placed onto the surface.

The playing piece dispensing means may be arranged to dispense playing pieces onto the surface in response to a player inserting a predetermined amount of credit into the machine. The credit can be purchased by any means common in the art such as coins, tokens, credit cards, etc.

Conveniently the machine comprises a transfer means to transfer playing pieces which have passed over at least one edge of the surface to the playing piece dispensing means. The transfer means may be an escalator, such as a coin escalator.

The machine may further comprise a playing piece counter arranged to count playing pieces passing over the edge of the surface.

Preferably, the surface, playing piece dispensing means, playing piece counter and transfer means constitute a closed loop for re-circulating playing pieces internally within the entertainment machine. Therefore, the playing pieces are not paid directly to a player and if the machine is tilted or shaken prizes are not dispensed. Although the pusher preferably has a closed loop arrangement, it is conceivable that an open loop pusher in which playing pieces are not circulated within the machine may be possible.

A playing piece detection means may be arranged to detect playing pieces passing over a win edge region of the surface. The win edge region preferably comprises a front edge region. It is traditional in coin pushers for coins falling over the front edge region of the surface to result in a win, and therefore such an arrangement is advantageous because it will be familiar to players of such machines. (The playing piece detection means may or may not be the same as the playing piece counter).

The machine may also be arranged to allow playing pieces to fall over losing edge regions of the surface, in which no prize is given for playing pieces falling thereover. The losing region preferably comprises side edge regions of the surface. Again, it is traditional in coin pushers for coins falling over edge regions to be lost from the game in progress, and such a machine will therefore be advantageous because it will be familiar to players of such machines.

The machine may be arranged to allow a plurality of players to play the machine at any one time (a multi-player game). However, in an alternative embodiment a single player machine may be provided.

In alternative embodiments the machine may be any other form of entertainment machine. The machine may be pool table, or the like, and balls provided for play on the table may be playing pieces. The machine may be a pin-ball machine, and the playing pieces may be balls provided for use in the machine.

According to a twelfth aspect of the invention there is provided an entertainment machine capable of receiving at least one playing piece having an identifier associated therewith, said machine comprising a playing piece identifier reading means.

The machine according to a twelfth aspect of the invention may have any of the features described in relation to the machine of the eleventh aspect of the invention.

According to a thirteenth aspect of the invention there is provided a method of improving the player appeal of an entertainment machine containing one or more playing pieces comprising providing at least one of the playing pieces with an identifier and providing the machine with a means to read the identifier.

According to a fourteenth aspect of the invention there is provided an entertainment machine comprising a playing surface arranged to support a plurality of playing pieces, a dispenser arranged to dispense playing pieces on to the surface, and a controller arranged to control the dispenser, the controller being arranged to cause the dispenser to dispense playing pieces onto the playing surface in predetermined situations to increase the perceived player appeal of the machine.

An advantage of such a machine is that it may help to ensure that the playing surface is populated with a sufficient number of playing pieces to help ensure that the machine is enticing to a player.

The machine may further comprise a timer, which is preferably arranged to time the time elapsed since the last time that a player played the machine. Preferably, the timer is arranged to pass the elapsed time to the controller. Such an arrangement can be convenient because it helps to allow the controller to determine whether the playing surface is enticing to players. Generally, if people are regularly playing the machine it is likely that they believe they have a good chance of winning and that the playing surface is therefore enticingly loaded. Conversely, if players are not playing the machine for long periods it may be inferred that they believe they have a low chance of winning and that therefore, the playing surface is not enticingly loaded. The time that a player last played the machine may be determined by the detection of a coin paid into the machine, maybe by a coin validator.

Alternatively, and perhaps in the preferred embodiment, the time that a player last played the machine may determined by arranging the timer to time from the last time that a playing pieces was released onto the playing surface. Such an arrangement is advantageous, because it may be possible for a player to insert a plurality of credits into the machine, such that a game may last for some time after the last credit/coin was paid to the machine.

The machine may comprise a counter, arranged to count the number of playing pieces falling from the playing surface, and preferably, the counter passes the number of playing pieces falling from the playing surface to the controller.

The counter may comprise a coin hopper. Such hoppers are a well-known means for counting coins in the field of entertainment machines. Alternatively, or additionally, the counter may comprise any other suitable means for counting playing pieces falling from the playing surface. For example any of the following may be suitable: a light beam and associated detector, a reed switch, etc.

The controller may be arranged to cause the dispenser to dispense a predetermined number of playing pieces onto the surface after a predetermined time has elapsed since the last time a player played the machine. Such an arrangement is advantageous because it may help to ensure that the playing surface becomes more enticing to players.

Alternatively, or additionally, the controller may be arranged to cause the dispenser to dispense playing pieces onto the playing surface, after a predetermined time has elapsed since the last time a player played the machine, until the counter has counted a predetermined number of playing pieces falling from the playing surface. Such an arrangement is also advantageous because it helps to ensure that the playing surface is enticingly loaded to players of the machine. This arrangement may be preferred over dispensing a predetermined number of playing pieces on to the surface because it may be more likely to produce an enticingly loaded playing surface.

The predetermined elapsed since the last time a player played the machine may be roughly any one of the following times, or roughly any time in between the any one of the following times: 1 min, 2 min, 3 min, 4 min, 5 min, 10 min, 15 min, 20 min, 25 min, 30 min, 35 min, 40 min, 45 min, 1 hour, 90 min, or any other time.

Preferably, the machine further comprises a tilt detection mechanism arranged to detect whether the machine has been tilted, or knocked and generates a tilt signal upon such detection. Preferably, the tilt signal is passed to the controller. An advantage of such a tilt detection mechanism is that the controller is alerted if a player is attempting to fraudulently obtain a prize from the machine by tipping, or knocking, the machine.

In some embodiments the controller is arranged to cause the dispenser to dispense playing pieces on to the playing surface if it receives a tilt signal. The controller may be arranged to dispense a predetermined number of playing pieces onto the surface on receipt of such a tilt signal.

Alternatively, or additionally, the controller may be arranged to cause the dispenser to dispense playing pieces onto the playing surface, after receipt of a tilt signal, until the counter has counted a predetermined number of playing pieces falling from the playing surface. Such an arrangement is also advantageous because it helps to ensure that the playing surface is enticingly loaded to players of the machine. This arrangement may be preferred over dispensing a predetermined number of playing pieces on to the surface because it is more likely to produce a playing surface which is enticing to players/potential players of the machine.

Additionally, or alternatively, the controller may be arranged to dispense an equal number of playing pieces on to the surface as the counter counted falling from the surface upon receipt of a tilt signal. Such an arrangement is advantageous because it is attempting to put the playing surface into the same state that it was in before playing pieces were fraudulently caused to fall from the playing surface.

In alternative, or additional embodiments, the controller may be arranged to dispense playing pieces on to the playing surface when the machine is turned on. Again, the controller may be arranged to dispense a predetermined number of playing pieces on to the playing surface, or it may be arranged to dispense playing pieces until the counter has counted a predetermined number of playing pieces falling from the playing surface.

In yet a further, alternative, or additional embodiment, the controller may be arranged to cause the dispenser to dispense playing pieces on to the playing surface in order to populate the playing surface with playing pieces. Such an arrangement may prove useful when the playing surface is free, or substantially free, of playing pieces. The controller may be arranged to cause the dispenser to dispense playing pieces in this manner, on a predetermined command, or may be automatically, if it determined that the playing surface has less than a predetermined number of playing pieces thereon. Such a feature may for instance be useful when a machine is installed, and commissioned, on site. The machine is likely to be installed with the surface free, or substantially free, from playing pieces, and such an arrangement may prove useful to populate the playing surface. Such a feature may also be useful for test purposes, perhaps during manufacture of the machine.

The controller may be arranged to cause the dispenser to dispense a predetermined number of playing pieces on to the playing surface, or may be arranged to cause the dispenser to dispense coins until the counter has counted a predetermined number of coins falling from the playing surface.

Preferably, the machine further comprises at least one hopper arranged to catch playing pieces falling from the playing surface. Further, the machine may comprise a transfer means arranged to transport playing pieces from the hopper to the dispenser.

In the preferred embodiment, the machine may comprise a closed loop, which comprises the playing surface, the hopper, the transfer means, and the dispenser. Such an arrangement is convenient because it separates coins paid into the machine by a player from the playing pieces on the playing surface. Of course, the machine may be arranged to use coins as the playing pieces.

The playing surface may comprise at least one winning edge. The machine may be arranged such that playing pieces falling over the winning edge cause a prize to be awarded to the player.

Further, the playing surface may comprise at least one losing edge. The Machine may be arranged such that playing pieces falling over the losing edge do not result in a prize being awarded to the player.

Preferably, either the counter is arranged to count playing pieces falling over the winning and the losing edges, or separate counters are provided to count playing pieces falling over the win and the lose edges. An advantage of counting both the playing pieces falling over the win and lose edges is that the controller can determine the number of playing pieces that are actually on the playing surface.

In embodiments in which the controller is arranged to cause the dispenser to dispense a predetermined number of playing pieces onto the surface the predetermined number may be roughly any one of the following, or any number in between any of the following: 1, 2, 3, 4, 5, 10, 15, 20, 25, 50, 100, or any other number.

In embodiments in which the controller is arranged to cause the dispenser to dispense playing pieces onto the playing surface until a predetermined number of playing pieces have fallen therefrom, the predetermined number may be roughly any one of the following, or any number in between any of the following: 1, 2, 3, 4, 5, 10, 15, 20, 25, 50, 100, or any other number. In the preferred embodiment, the predetermined number is roughly ten.

Preferably, the machine can be freed for play using any mechanism that allows a player to input credits to the machine. Such mechanisms commonly include coins, credit cards, tokens, or the like.

According to a fifteenth aspect of the invention there is provided a machine according to the fourteenth aspect of the invention in which there are provided a plurality of playing pieces for use in the machine.

According to a sixteenth aspect of the invention there is provided a method of increasing the player appeal of an entertainment machine comprising causing the machine to dispense playing pieces onto a playing surface thereof in order to increase the player appeal of the arrangement of the playing pieces supported by the playing surface.

According to a seventeen aspect of the invention there is provided a machine readable medium containing instructions to cause an entertainment machine to perform the method of the sixteenth aspect of the invention.

The machine readable medium may comprise any one or more of the following: a floppy disk, a CDROM, a DVD ROM/RAM, a magneto optical disk, a transmitted signal (which may be an internet download, or any other transmission between two or more computing devices).

According to an eighteenth aspect of the invention there is provided an entertainment machine arranged to provide a payout, the machine comprising a payout controlling means arranged to control the payout, a playing surface arranged to support one or more playing pieces and further arranged to allow playing pieces to fall therefrom, a relationship determining means arranged to determine a relationship between the payout and at least one other variable and further arranged to generate a signal, a controller arranged to receive the signal and to control the payout controlling means in order that the relationship tends towards a predetermined value.

An advantage of such a machine is that it can be used to ensure that an enticing game is provided to players thereof. It will be appreciated that players play such machines in the hope that they do well and generally that they receive a prize for their efforts. If the payout from the machine is too low then the machine can be un-enticing, and if the payout is too high then the machine can be unprofitable. Therefore, it is advantageous to provide a machine that can vary the payout rate to ensure that the machine remains enticing, and profitable.

Preferably, the controller contains a data processing means.

Generally, the machine is arranged to allow playing pieces to fall onto the playing surface.

Preferably, the machine further comprises a pusher arranged to periodically disturb playing pieces arranged on said playing surface. Such an arrangement is convenient because it helps to ensure that, in use, some playing pieces do fall from the playing surface.

The playing surface may comprise at least one winning edge over which playing pieces can fall. Further, the machine may comprise at least one losing edge over which playing pieces can fall. In some embodiments, the machine is preferably arranged such that playing pieces falling over said winning edge contribute to an award made to a player, and further arranged such that playing pieces that fall over said losing edge do not contribute to an award made to a player.

In some embodiments of the machine no losing edge is provided. In such embodiments the payout controlling means may be arranged to payout a portion of playing pieces falling from the playing surface to the player.

Conveniently, the machine comprises at least one counter which may be arranged to count playing pieces falling from the playing surface. The or each counter is preferably capable of generating a count signal which may be fed to the controller.

The or each counter may alternatively or additionally be arranged to count playing pieces falling onto the playing surface.

The number of playing pieces falling from the playing surface may provide the at least one other variable. Alternatively, or additionally the number of playing pieces falling onto the playing surface may provide the other variable.

In the preferred embodiment a counter is provided and arranged to count playing pieces passing over said winning edge and count the playing pieces introduced onto the playing surface. Such an arrangement is convenient because it allows a payout percentage, in which the number of playing pieces falling over said winning edge is compared to the number of playing pieces introduced onto the playing surface, to be determined.

In practice, the payout controlling means may be controlled to affect a payout parameter calculated in the following way. Processing circuitry is provided which is capable of recording and amending a cumulative total. For every playing piece that falls over the winning edge, 100 is added to this total. For every playing piece that is introduced to the playing surface, a number is deducted. This number reflects the selected payout percentage. If, for example, an 80% payout is considered desirable, for every playing piece that is introduced to the playing surface, 80 is deducted from the cumulative total. The desired value of the cumulative total at any time is zero. A value greater than zero indicates that the payout percentage is higher than the desired value. A value below zero indicates that the payout percentage is too low Preferably, the relationship determined by the relationship determining means is the payout parameter.

Alternatively or additionally, the at least one other variable may be a ratio between playing pieces that fall from the winning edge and playing pieces that fall from the losing edge.

Conveniently, the or each counter is arranged to determine the value of playing pieces. Such an arrangement is convenient because is allows playing pieces of different values to be arranged on the playing surface. In machines in which playing pieces of different value are used on the playing surface the payout of the machine is not purely a function of the number of playing pieces falling from the playing surface, but also of their value. Therefore, determining the value of playing pieces falling from the surface allows the payout of the machine to be accurately controlled.

The or each counter may be arranged to pass the value of the playing pieces introduced to the playing surface and falling from the winning edge and/or losing edge to the controller, and further the controller may be arranged to influence the payout in relation to the relationship, the relationship being calculated using the value(s) of playing pieces rather than their quantity. That is the value of playing pieces falling onto/from the playing surface may provide the other variable rather than the number of playing pieces.

Conveniently, payout controlling means may be arranged to influence the payout by influencing the rate at which playing pieces fall from the playing surface.

One, or more, walls may be provided at an edge region of the playing surface. Such walls define regions of the playing surface from which playing pieces cannot fall. Therefore, as the length of the walls provided around the playing surface increases the rate at which playing pieces can fall from the playing surface may decrease. The controller may be arranged to vary the length of the wall to influence the rate at which playing pieces are arranged to fall from said playing surface and the wall may constitute the payout controlling means.

Further, a moveable lip may be provided in a region of an edge of the playing surface. The moveable lip is generally provided in a region of the winning edge, but may be provided in a region of the losing edge. Preferably, the moveable lip is angularly moveable, and may be hinged. Such an arrangement is convenient because it allows the rate at which playing pieces fall from the edge to be controlled, by altering the position of the lip. The controller may be arranged to control the position of the lip to influence the rate at which playing pieces are arranged to fall from said playing surface and the lip may constitute the payout controlling means. In addition, such a lip causes coins to stack on top of each other and therefore may tend to increase the size of stacks of coins in a region of the lip. A player is likely to keep playing a machine if such a stack is near the winning edge and may soon make a contribution to a payout; the larger the stack of coins that fall the larger the payout.

The controller may be arranged to alter the angle of the playing surface to influence the rate at which playing pieces are arranged to fall from said playing surface and the angle of the playing surface may constitute the payout controlling means. If the playing pieces are required to move up a positive slope the rate at which they move toward an edge is likely to be reduced, and if the playing pieces are assisted by a negative slope the rate at which they move toward an edge is likely to be increased.

The playing surface may be arranged to be contoured by the controlling means to influence the rate at which playing pieces are arranged to fall from the playing surface. Contouring the slope by having sections of the playing field with individually variable slopes could affect the payout rate.

Playing surfaces with one or more studs are well known in the art. The primary purpose of these studs is to cause the playing pieces to ride over one another and subsequently stack on top of each other. A player is likely to keep playing a machine if he/she believes that such a stack is soon to reach the front edge.

The playing surface may be provided with one or more protrusions, which may be studs, or the like. The controller may be arranged to alter the angle, the extent of protrusion, or the like, in order to affect the rate at which the playing pieces move across the playing surface to influence the rate at which playing pieces are arranged to fall from said playing surface and the protrusions may constitute the payout controlling means.

The protrusions may be profiled to affect the direction of the progression of the playing pieces. Their angle of orientation and/or their protrusion could be controlled to vary the effect.

The controller may be arranged to control the motion of the pusher to influence the rate at which playing pieces are arranged to fall from said playing surface, and the control of the pusher may constitute the payout controlling means. It will be appreciated that if the pusher were to move further across the playing surface than usual, it is likely that more playing pieces would be caused to fall therefrom.

In an alternative, or additional, embodiment the controller may be arranged to alter the angle of the pusher relative to an edge so that the general direction of the progression of the playing pieces is not directly towards that edge. Therefore, controlling the angle or amplitude of the motion of a variable-motion pusher provides a payout controlling means.

The payout controlling means may be controlled by one, or more, motors, which are arranged to be controlled by the controller. Alternatively, or additionally, the payout controlling means may be controlled by any other suitable actuation mechanism. For example, the payout controlling means may be controlled by pneumatics, hydraulics, etc.

Alternatively, the payout controlling means may not be arranged to influence the rate at which playing pieces fall from the playing surface, but may instead be arranged to alter the relationship between playing pieces which fall from a winning edge to an award made to a player.

The machine may comprise a payout mechanism capable of generating a payout. The controller may be arranged to control the payout mechanism such that it generates a payout of a predetermined value in relation to playing pieces falling from the playing surface i.e. the relationship is the relationship between the payout and the value or number of playing pieces falling from the winning edge. The predetermined value may be determined by the processing circuitry and the method for determining the determined value may vary in order that the relationship between the number of playing pieces falling on to the playing surface and the machine payout tends towards the predetermined relationship. In this way, the payout mechanism may constitute the payout controlling means. Such an arrangement is convenient as it requires no substantial additions to the construction of the machine.

Preferably, the predetermined value may generally be calculated using a first method but may be calculated using a second method when at least a predetermined number of playing pieces are caused to fall from the playing surface by a single motion of the pusher. An advantage of such a method is that it can be used to ensure that players do not begin to distrust the machine. The player will generally expect that the playing pieces that fall from the playing surface to contribute to the payout of the machine in a consistent manner. The player will not be able to readily discern the exact number of playing pieces that fall from the playing surface if that number is large, and will therefore be unaware that the contribution the playing pieces have made to the payout has altered.

The predetermined number of playing pieces that cause the second method of calculating the predetermined value may be roughly any one of the following playing pieces: 5, 6, 7, 8, 9, 10, 15, 20, 25, 30, or more or any number in between these.

The predetermined value may be determined using the number of playing pieces that have been caused to fall from the playing surface by a single motion of the pusher as a parameter. Alternatively, the predetermined value may be determined using the value of playing pieces that have been caused to fall from the playing surface by a single motion of the pusher.

Advantageously, the predetermined value may be determined using a first method when the relationship between the number of playing pieces falling onto the playing surface and the payout is roughly the predetermined relationship and by a second or further method when the relationship is significantly different from the predetermined relationship.

Advantageously, the predetermined value may be determined using the difference between the relationship and the predetermined relationship as a parameter.

Such a method is convenient as it allows the payout to tend towards the predetermined relationship rapidly if the relationship is very different from the predetermined relationship.

The payout controlling means described above could be used individually or in any combination to control the pay out rate and/or parameter constantly, at regular intervals, while the machine is not in use or at any other time.

Conveniently, the machine comprises a dispenser arranged to dispense playing pieces onto the playing surface. The machine may comprise a transfer means arranged to transfer playing pieces that have fallen from the playing surface to the transfer means. The playing surface, the transfer means, the counter, and the dispenser may constitute a closed loop in which playing pieces are recirculated.

In an alternative embodiment, the machine may not comprise a closed loop, and at least a portion of the playing pieces falling from the playing surface may be paid directly to a player.

The playing pieces may comprise coins, which may be paid into the machine by a player.

The controller may be arranged to provide periods in which the payout percentage or rate is enriched. The machine may be provided with a display means to indicate that the machine is operating in an enriched period. Such an arrangement may be convenient because it may encourage players to play the machine.

The controller may be arranged to periodically vary the payout percentage perhaps to provide periods of enriched payout by allowing the payout parameter to increase. An advantage of such a machine is that it may function more like a machine having no control of the payout percentage; the introduction of a payout controlling means controlled by a controller is likely to tend to smooth the payout percentage so that it is more or less constant. Prior art machines may have had a significant variation in the payout percentage measured at snapshots over a period of time. Variations in the payout percentage may prove appealing to a player and make them more likely to play the machine.

According to a nineteenth aspect of the invention there is provided a method of controlling the payout of an entertainment machine having a playing surface arranged to support one or more playing pieces and from which playing pieces may fall, the method comprising counting the playing pieces that fall onto the surface and adjusting a payout controlling means to influence the payout in order that the relationship between the number of playing pieces falling onto the playing surface and the payout tends towards a predetermined relationship.

The rate at which the playing pieces fall from the surface, the ratio of winning playing pieces to losing playing pieces, the payout parameter or percentage, the manner in which winning playing pieces contribute to a payout or any other suitable criteria may be influenced by the payout controlling means.

Conveniently, each the payout controlling means may affect the payout rate and/or parameter in a way that is qualitatively and/or quantitatively known. Most preferably a controller can control the payout controlling means in order to adjust the payout rate and/or parameter until it reaches a predetermined value.

According to a twentieth aspect of the invention there is provided a computer readable medium containing instructions, that when read by an entertainment machine cause that entertainment machine to perform the method of the nineteenth aspect of the invention.

The computer readable medium may be any one or more of the following: a floppy disk, a CDROM, a DVD ROM/RAM, a magneto optical disk, a memory (ROM, RAM, etc.), a transmitted signal (which may be an internet download, or other signal).

According to a twenty-first aspect of the invention there is provided an entertainment machine comprising a playing surface arranged to support one or more playing pieces and further arranged to allow playing pieces to fall therefrom, a controller arranged to control a payout controlling means, and at least one counter arranged to count playing pieces falling from said playing surface and generate a counting signal which is fed to said controller, said controller being arranged to control said payout controlling means to influence the rate at which playing pieces are arranged to fall from said playing surface.

Features of the eighteenth aspect of the invention may be applied to the twenty first aspect of the invention.

According to a twenty second aspect of the invention there is provided a method of controlling the payout of an entertainment machine having a playing surface arranged to support one or more playing pieces and from which playing pieces may fall, the method comprising counting the playing pieces that fall onto the surface and adjusting a payout controlling means to influence how the playing pieces fall from the surface.

According to a twenty third aspect of the invention there is provided an entertainment machine comprising a playing surface arranged to support a plurality of playing pieces, at least one counter arranged to detect playing pieces falling from the playing surface and generate a detection signal that is passed to a controller, and at least one prize dispenser, the machine being arranged such that the controller is arranged to allow the prize dispenser to dispense a prize when one or more predetermined detection signals have been received thereby.

An advantage of such a machine is that a prize may provide a greater incentive than simply collecting coins (or the monetary equivalent of playing pieces) that have fallen from the playing surface, which have previously been paid by such machines. A further advantage is that staff or management of the premises in which the machine is placed have less of a burden imposed on them in maintaining the machine. It is necessary that the prize dispenser is loaded with prizes, but there is no need to ensure that prizes, etc. are optimally placed on the playing surface, etc.

Preferably, the playing surface comprises at least one winning edge, and the machine is arranged such that playing pieces falling over the winning edge count towards an award to be made to a player of the machine. The playing surface may further comprise at least one losing edge, and the machine is arranged such that playing pieces falling thereover do not count towards an award to be made to a player. Such an arrangement is convenient because it is familiar to players of such machines.

A counter may be provided to count playing pieces passing over the winning edge and a counter may be provided to count playing pieces passing over the losing edge. Alternatively, one counter may be arranged to count playing pieces passing over both the winning and losing edges. The at least one counter preferably is arranged to allow the controller to count the playing pieces falling from the playing surface. Such an arrangement is convenient because it allows the controller to determine how many playing pieces are on the playing surface at any one time. (If it is also determined how many playing pieces are added to the playing surface).

Conveniently, the machine may be arranged to assign a value to playing pieces. For example a single playing piece may be assigned a monetary equivalent, a number of points, or the like. An advantage of such an arrangement is that it may make the value of playing pieces falling from the playing surface more real to a player of the machine.

The counter may be arranged to detect the value assigned to a playing piece, and may be arranged to pass the value of the playing piece to the controller.

The machine may comprise a win bank, which may be a portion of a memory of the controller, arranged to accumulate the number of playing pieces and/or the value of playing pieces falling from the playing surface, preferably from the winning edge of the playing surface.

The machine may comprise a display, which is driven by the controller. The display may be arranged to display the value held in the win bank (which may be the number of pieces falling from the playing surface, or the value of playing pieces falling from the playing surface). Such an arrangement is convenient because it provides feedback to the player as to how many pieces have fallen, and therefore, informs them as to how well he/she is doing in his/her turn at the machine.

The prize dispenser may be arranged to dispense containers holding a prize. Such an arrangement is convenient because it allows prizes of a variety of sizes and shapes to be dispensed more easily.

In some embodiments the machine may comprise two or more prize dispensers. Such an arrangement may prove convenient because it allows prizes of different values to be dispensed. Prizes having a first value may be dispensed from a first prize dispenser and prizes having a second value may be dispensed from a second prize dispenser, etc.

The prize dispenser may be arranged to be added to an existing machine. Such an arrangement is convenient because it may allow prize dispenser to be retro-fitted.

Conveniently, the prize dispenser contains a stack of containers. Further, the prize dispenser may be arranged to move, preferably by pushing, one of the containers from the stack to award a prize to a player. It is convenient if it is the bottom, or the top, container in the stack, but it possible to move any one of the containers within the stack.

Preferably, the machine is provided with a prize dispense request input means arranged to provide a prize request to the controller. Such an arrangement is convenient because it allows a player to convert his/her winnings into prize, which is subsequently dispensed from the prize dispenser.

The machine may be arranged to associate a value with a prize dispensed from the machine. Further, the machine may be arranged such that the controller decrements the value associated with a prize from the value held in the win bank when a prize is caused to be dispensed. Such an arrangement is convenient because it allows players to accumulate value in the win bank and then convert this value into a prize. Therefore, the player can play the machine and "save" for prizes requiring a higher number of points.

Preferably, the controller will only cause the prize dispenser to dispense a prize on receipt of a prize request if the value held in the win bank is greater than, or equal to, the value associated with the prize that has been requested. Such an arrangement, of course, prevents players from obtaining prizes having a greater value than they have won.

The prize dispense request input means may simply comprise a button, or the like, that a player can press to cause a prize to be delivered from the prize dispensing means.

Alternatively, or additionally, the prize dispense request input means may comprise a selector from which a player can select the prize he/she desires. The prize from which they can select may be prizes held within the machine, or may be from a range of prizes that can be obtained externally of the machine.

The selection means may comprise a display arranged to display various prizes to a player. Alternatively, or additionally, the selection means may be arranged to allow a player to input a code associated with the players desired prize to cause the prize dispenser to deliver that prize.

The machine may be arranged to dispense non-monetary prizes. Alternatively, or additionally, the machine may be arranged to dispense cash prizes. The player may be able to chose between having a cash prize paid to him/her, or the prize dispensed by the prize dispensing means may comprise a cash prize. (For example, the prize may comprise coins/notes within a container).

Preferably, the machine is arranged to be freed for play by coins, tokens, credit cards, or any other suitable means for introducing credits.

The machine may comprise a transfer means arranged to transport playing pieces to the dispenser, generally from the counter, or alternatively, from a collection region after playing pieces have fallen from the playing surface.

In the preferred embodiment, the machine may comprise a closed loop, which comprises the playing surface, the counter, the transfer means, and the dispenser. Such an arrangement is convenient because it separates coins paid into the machine by a player from the playing pieces on the playing surface. Of course, the machine may be arranged to use coins as the playing pieces. The invention is advantageous for such machines having a closed loop, because it allows a variety of prizes to be paid to the player. It will be appreciated that prior art machines without closed loops allow objects to be placed on the playing surface, which are then awarded to the player when they fall from the playing surface. However, as discussed above, such arrangements lack security, etc.

According to a twenty fourth aspect of the invention there is provided a machine according to the twenty second aspect of the invention in which there are provided a plurality of playing pieces for use in the machine.

In one embodiment the playing pieces comprise a set of playing pieces containing playing pieces of different values. Conveniently, playing pieces of different value are visually discernible from one another. For example playing pieces of a first value may be a first colour and playing pieces of a second value may be a second colour. Such an arrangement is convenient because a player can readily determine the value of playing pieces that are in a region of an edge of the playing surface. Therefore, if there are high value playing pieces in a region of the edge of the playing surface, a player may be provided with more incentive to play the machine.

At least one of the playing pieces may have identification means therein allowing them to be identified. The identification means may comprise RFID tags, or the like.

According to a twenty fifth aspect of the invention there is provided a method of increasing the player appeal of an entertainment machine arranged to provide a plurality of playing pieces upon a playing surface such that said playing pieces are capable of being dislodged from the surface, and the method comprising causing the machine to dispense non-monetary prizes after a predetermined number and/or value of playing pieces have fallen from the playing surface.

The method may comprise associating a predetermined value with a playing piece and may further comprise providing playing pieces of two or more predetermined values on the playing surface. An advantage of such a method is that the player appeal of the machine may be increased if a playing piece having a high value is about to fall from the playing surface.

The method may comprise providing one or more playing pieces of a predetermined value. For example, playing pieces having a first predetermined value and a second predetermined value may be placed on to the playing surface. The method may further comprise providing more playing pieces of the first predetermined value, when compared to playing pieces of the second predetermined value. For example, the ratio of playing pieces of the first value to playing pieces of the second value may be roughly any one or more of the following (or any ratio in-between): 2:1, 3:1, 4:1, 5:1, 6:1, 7:1, 8:1, 9:1, 10:1, 15:1, 20:1, 25:1.

The method may comprise providing a prize when a playing piece having a predetermined value, preferably the second predetermined value, falls from the playing surface, and preferably falls over a winning edge of the playing surface.

Conveniently, the method allows a player to determine whether they wish to receive a prize, or receive a monetary equivalent of a prize. Such a method is convenient because it may provide more appeal to a wider range of players; some players may prefer cash, whilst others may prefer a prize. Generally, through the advantages of bulk purchasing, etc. the owners of the machine may be able to provide prizes of greater value, or greater perceived value, than cash payouts that could be made from the machine and keep the machine running at a profit.

According to a twenty sixth aspect of the invention there is provided a machine readable medium containing instructions to cause an entertainment machine to perform the method of the twenty fifth aspect of the invention.

The machine readable medium may comprise any one or more of the following: a floppy disk, a CDROM, a DVD ROM/RAM, a magneto optical disk, a transmitted signal (which may be an internet download, or any other transmission between two or more computing devices).

Embodiments of the invention will now be described by way of example only with reference to the following drawings.

Figure 18:
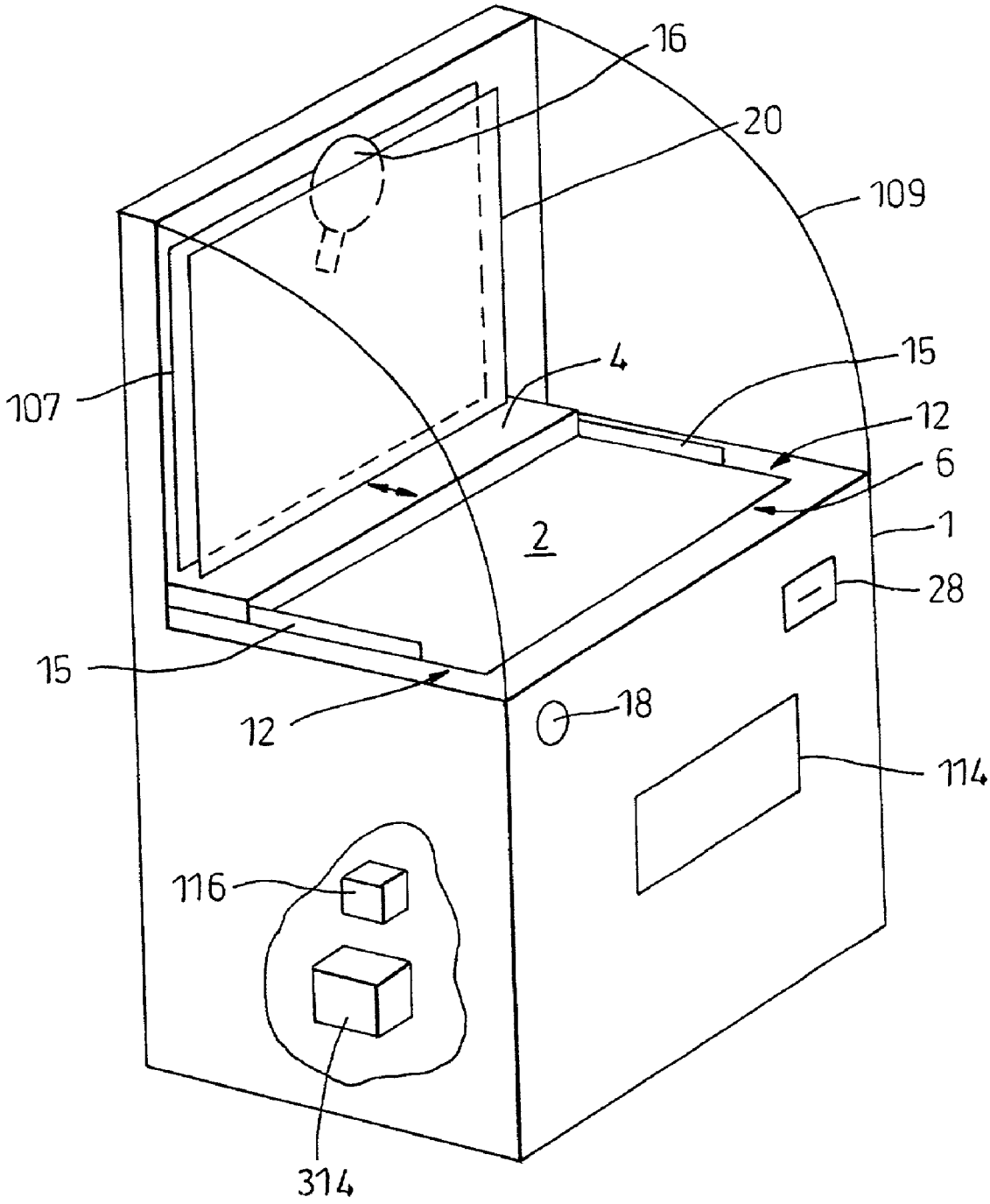
FIG. 18 shows a perspective view of a pusher according to one embodiment of the present invention.
Figure 20:
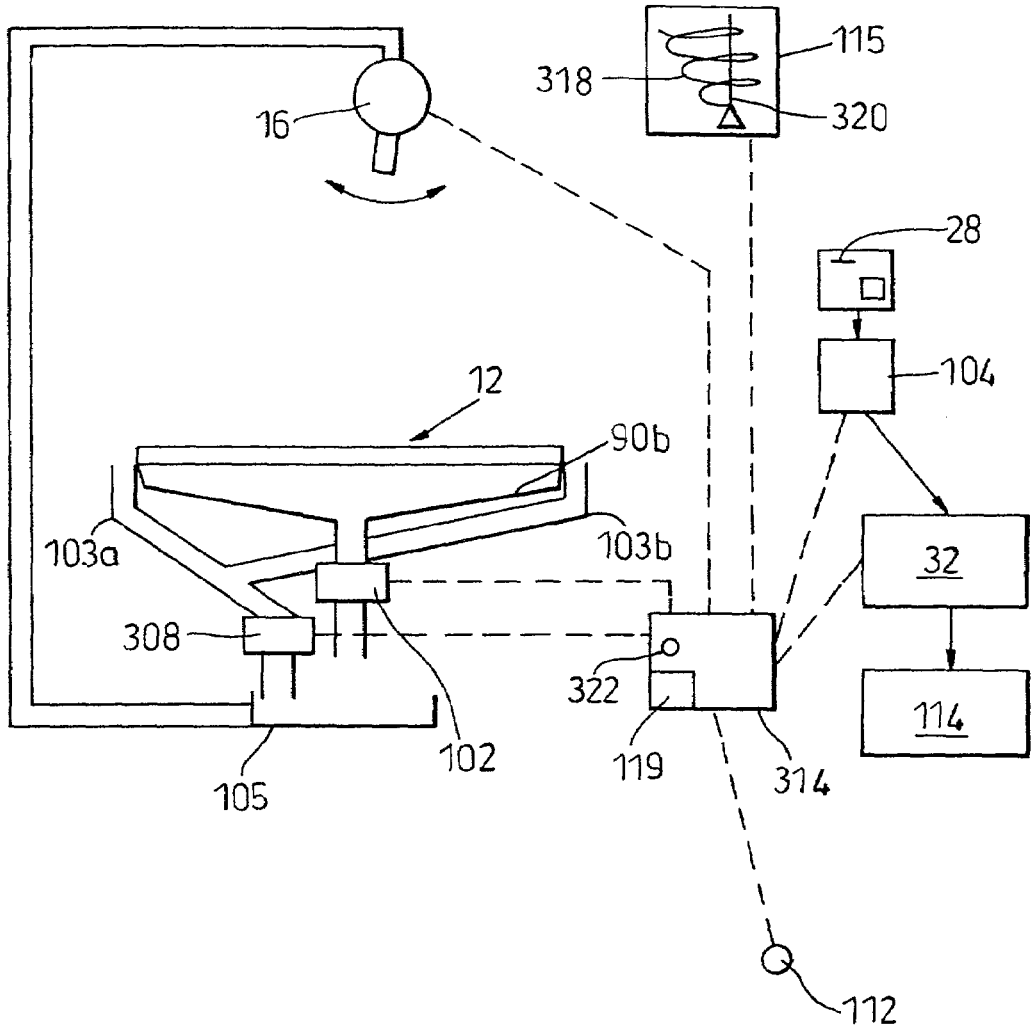

FIG. 20 schematically shows the components of the machine of FIG. 18.

Figure 21:
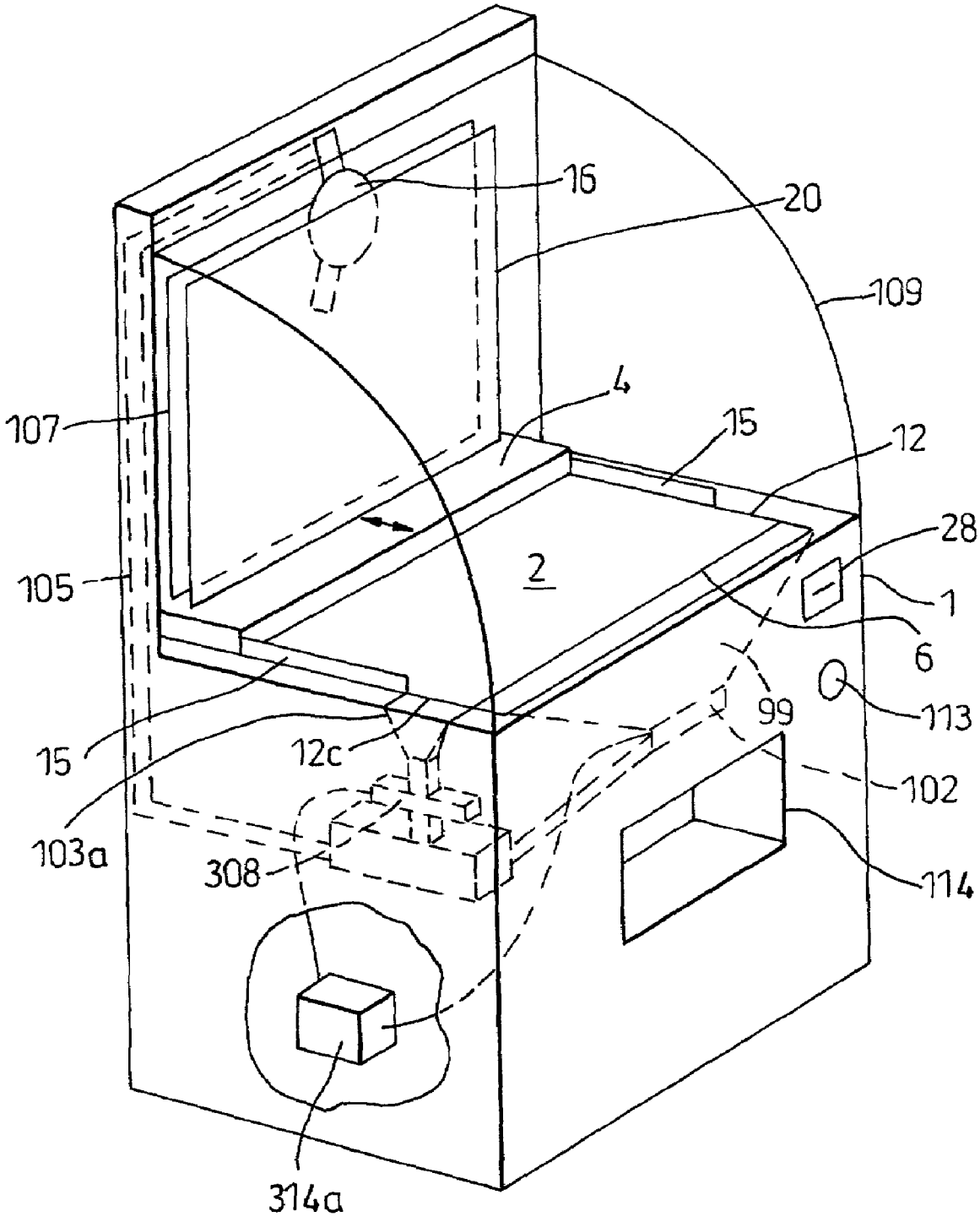
Figure 28:
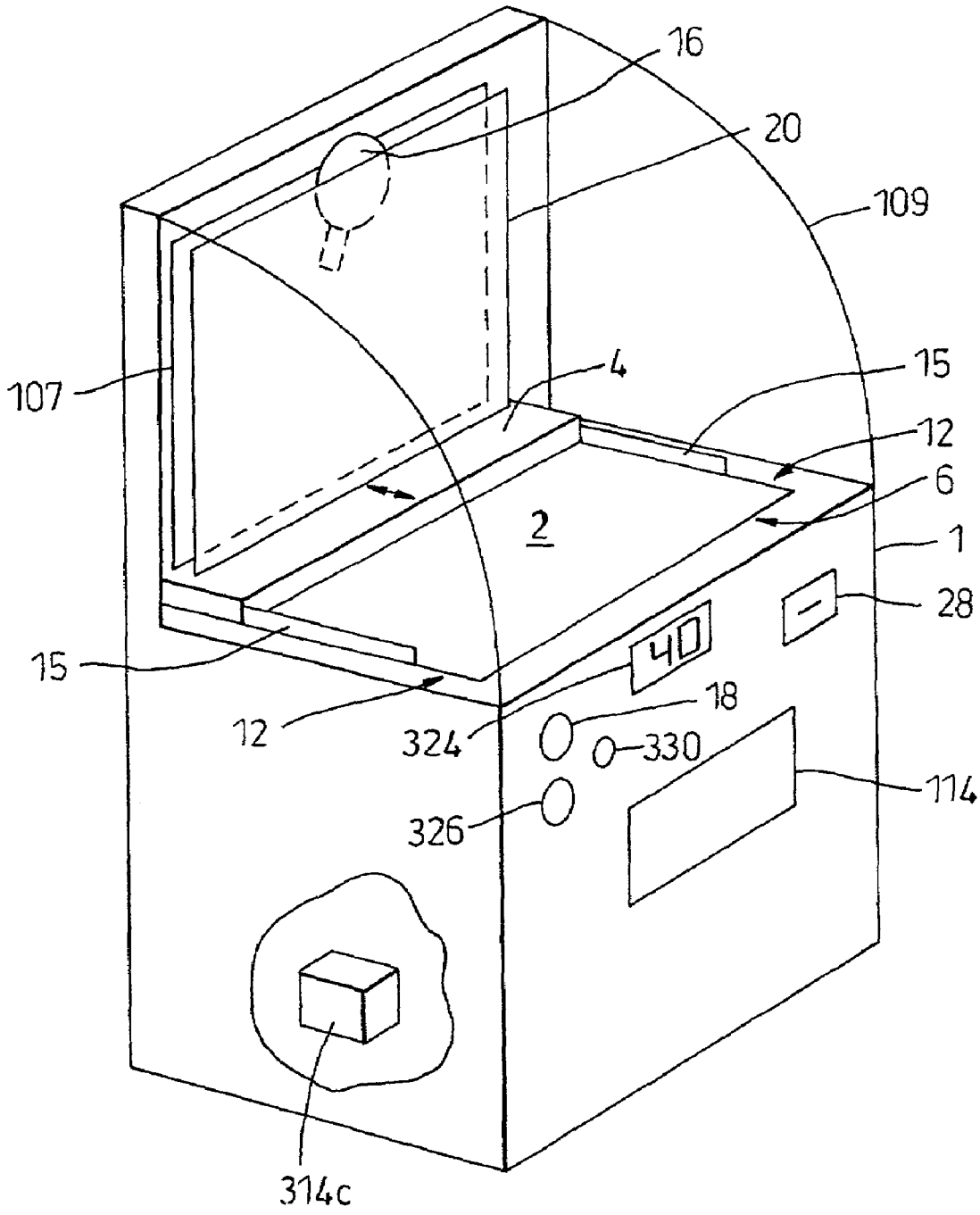
Figure 29:
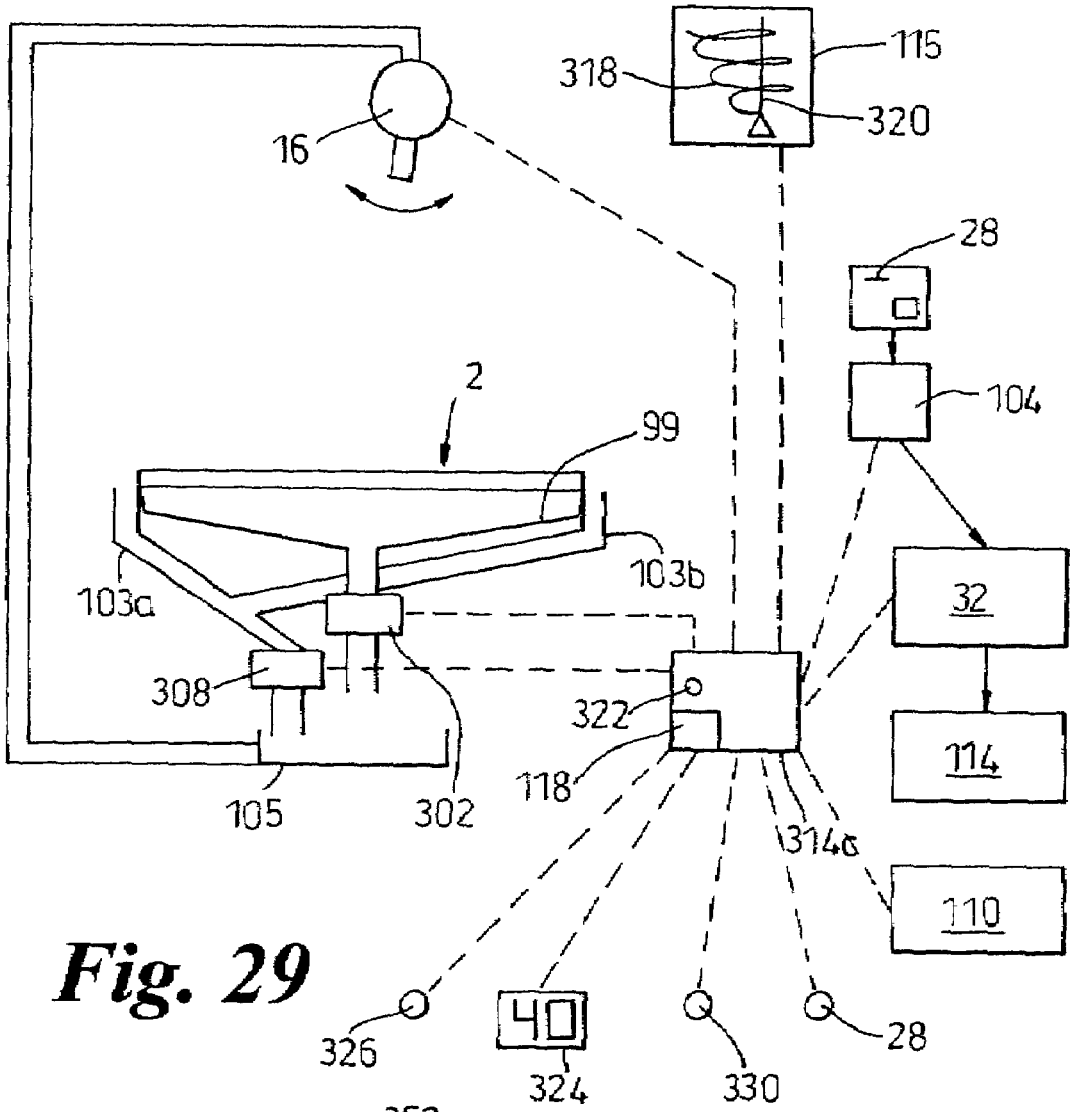
Figure 30:
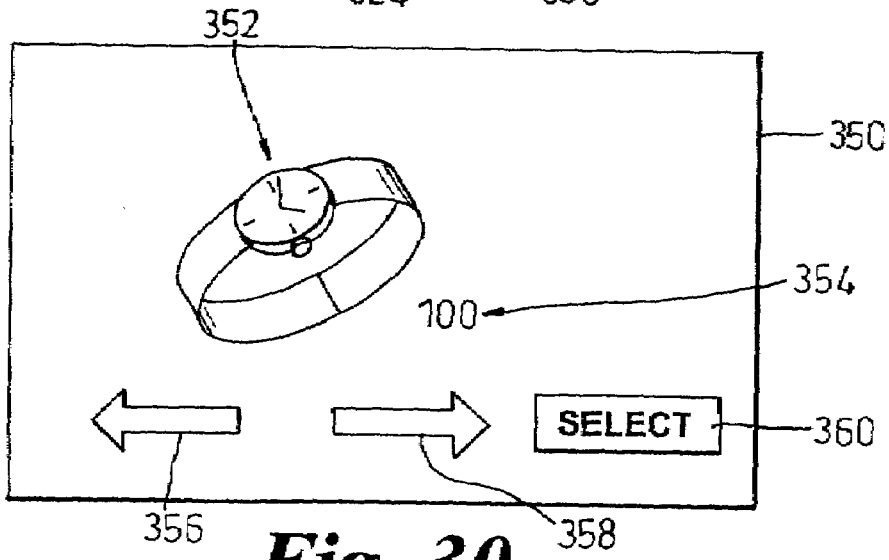
Figure 31:
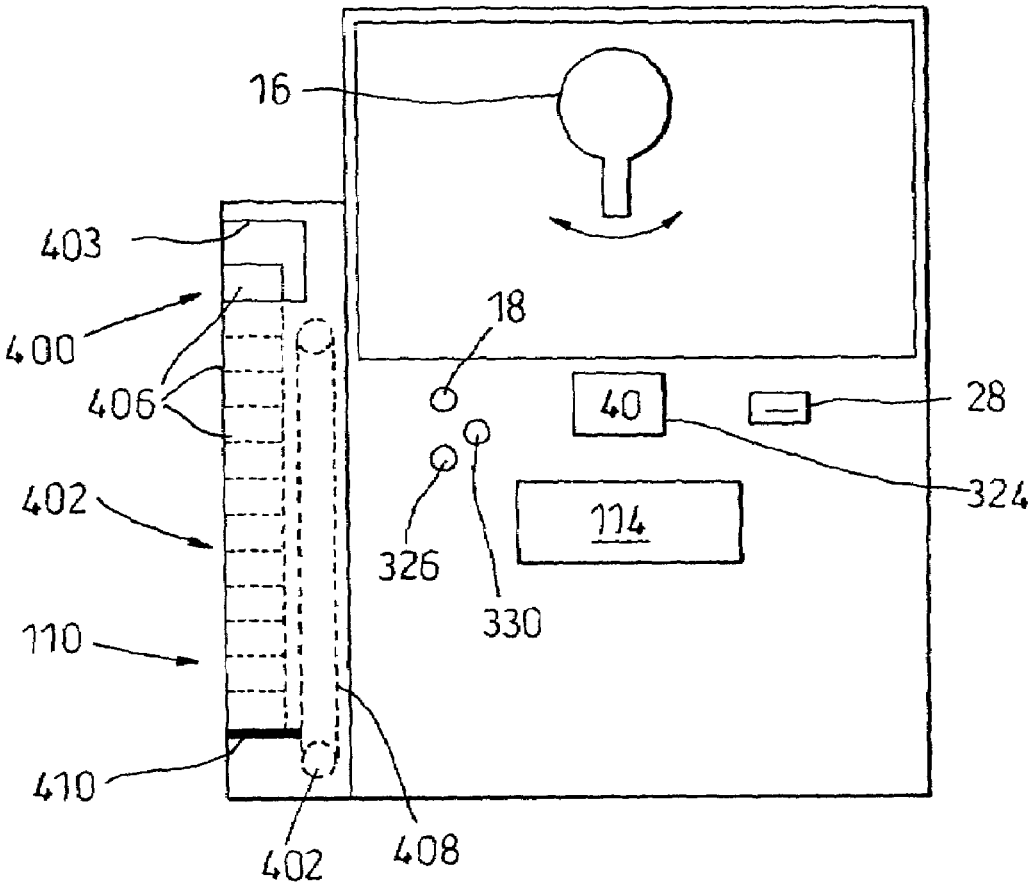
Figure 32:
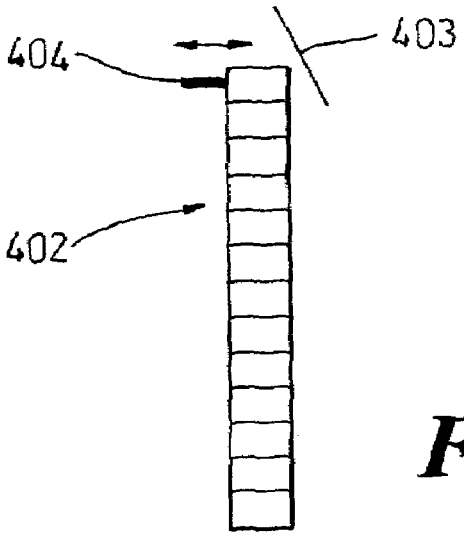

FIG. 21 shows an example of a pusher according to one embodiment of the present invention;

FIGS. 22–27 shows details of improvements according to one embodiment of the present invention that may be applied to a machine of the type shown in FIG. 21;

FIG. 28 shows a pusher according to one embodiment of the present invention;

FIG. 29 schematically shows the components of the machine of FIG. 28;

FIG. 30 shows schematically a selector allowing a player to select a prize;

FIG. 31 schematically shows a front elevation of the machine of FIG. 28 onto which a prize dispenser has been added; and FIG. 32 shows a side elevation of the prize dispenser of FIG. 31.

Figure 1:
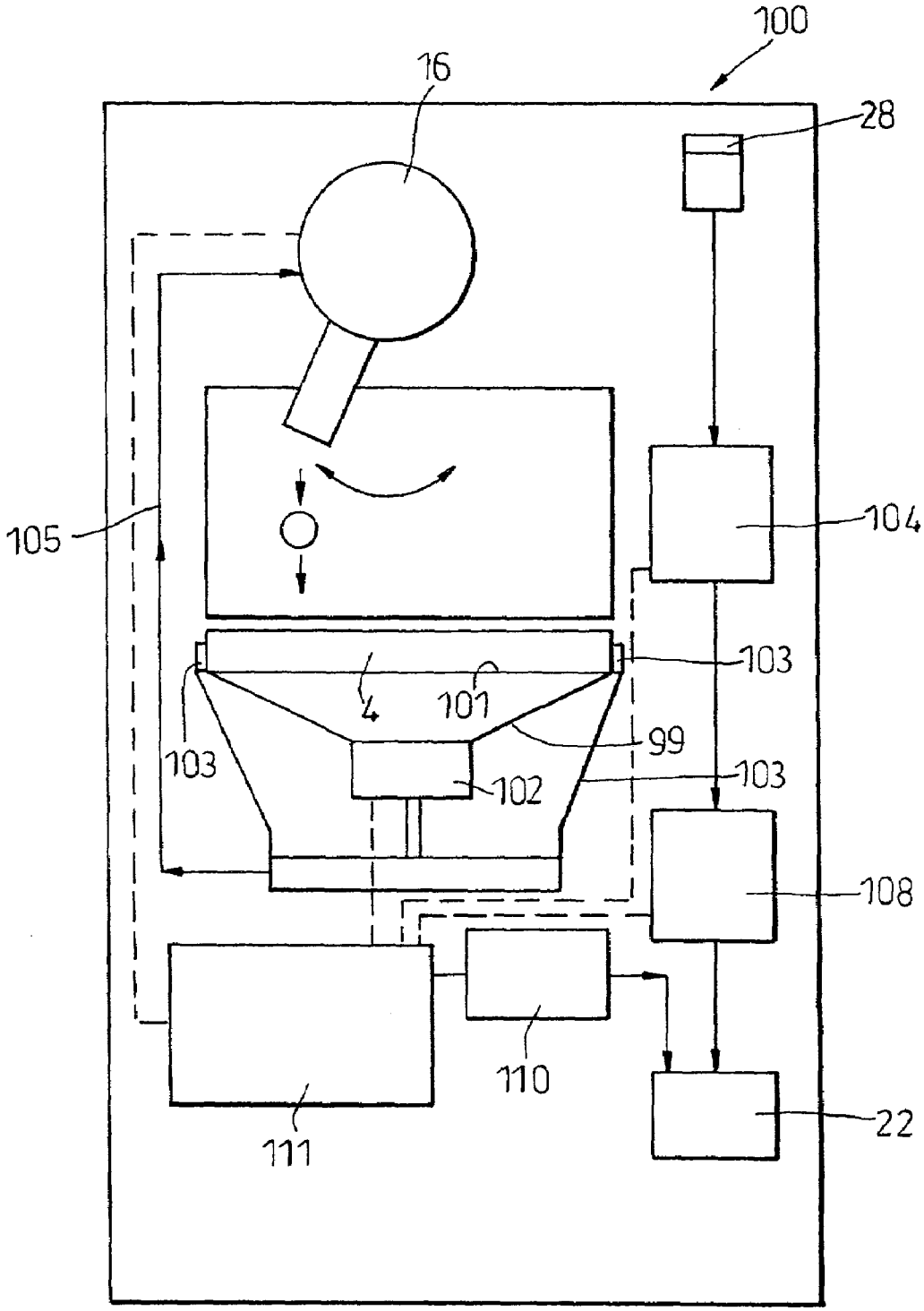
FIG. 1 shows an entertainment machine according to a first embodiment of the invention.

Shown in FIG. 1 is a coin pusher entertainment machine 100. The machine 100 has a surface 101, shown in more detail in FIG. 2, and a playing piece detecting means 102 arranged to detect first playing pieces within a mixture of first and second playing pieces passing over at least one edge of the surface 101. A pusher 4 is provided above the surface 101 and arranged to reciprocate to cause playing pieces to move in the general direction of a front edge region of the surface 101. However, there is some movement toward side edges of the surface 101.

A win chute 99 is arranged to catch playing pieces falling over a win edge region (the at least one edge), in this case the front edge, of the surface and direct them to the playing piece detecting means 102. A lose chute 103 is arranged to catch playing pieces falling over a lose edge region, in this case side edges, of the surface 101.

A directional playing piece dispensing means 16 dispenses playing pieces onto the surface 101 when activated by a player. The playing piece dispensing means 16 is arranged to constantly oscillate at a predetermined frequency over a roughly 90° arc, and a player must press a button (not shown) when they wish a playing piece to be released from the dispensing means 16, assuming that he/she has enough credits. A transfer means, in this case an escalator 105, is provided to transfer playing pieces that have fallen into the win 99 or lose 103 chutes back to the playing piece dispensing means 16. Thus, playing pieces are circulated within a closed loop comprising the surface 101, the win 99/lose 103 chutes, the playing piece detecting means 102, the escalator 105, and the dispensing means 16.

A coin slot 28 for receiving coins is connected to a coin validator 104 that validates the coins entered in the slot 28. A coin dispenser 108 is connected to the coin validator 104 so as to allow coins to pass from the validator 104 to the coin dispenser 108. The coin dispenser is further connected to a coin store 22. A prize dispenser 110 is also connected to the coin store 22 and can dispense prizes such as watches, high value coins or notes.

A control system 111 controls the functionality of the machine and is electrically connected to send and receive signals to and from the prize dispenser 110, coin dispenser 22, coin validator 104, playing piece detecting means 102, escalator 105, and playing piece dispensing device 104.

As described above the playing pieces capable of resting on the surface 101 circulate in a closed loop. The coins entered by the player through coin slot 28 cannot enter this closed loop.

Figure 2:
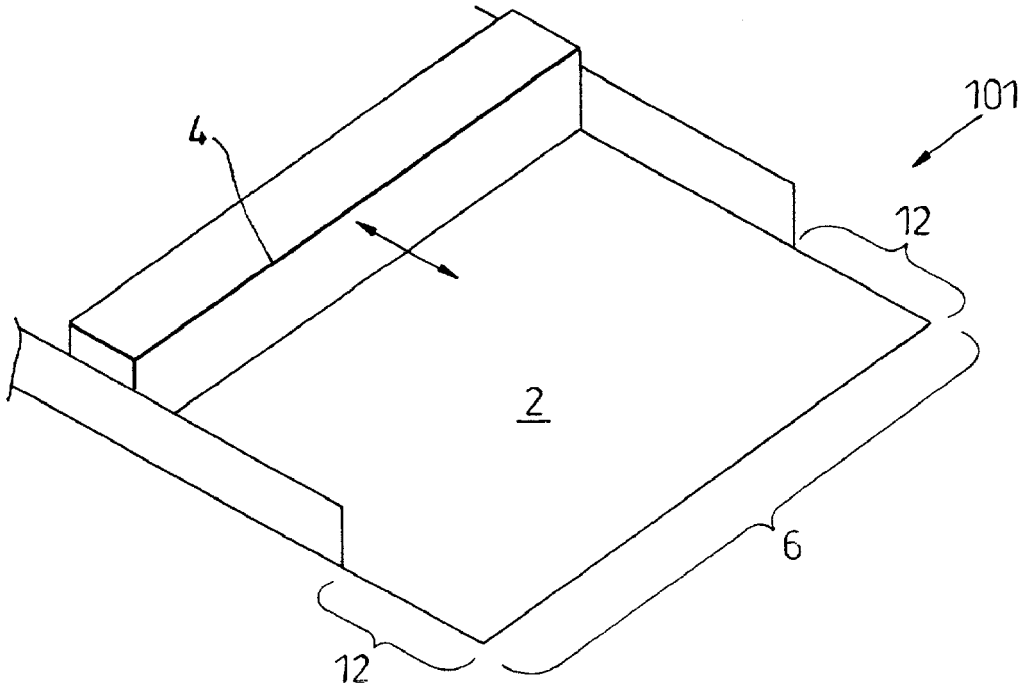
FIG. 2 shows a tray and pusher according to one embodiment of the invention.

FIG. 2 shows an enlarged view of the surface 101 and pusher 4. The surface 101 has a substantially flat upper surface 2 arranged to hold one or more first playing pieces and one or more second playing pieces. The surface 101 has a win edge region 6, in this case comprising a front edge of the surface over which the playing pieces can pass and fall into the playing piece detection means 102. The surface also comprises two losing edge regions 12, which in this case are front portions of the side edges of the surface 101. If playing pieces fall over the losing edge region they fall into the lose chute 103 and bypass the playing piece detecting means 102. The pusher 4 linearly reciprocates across the surface 2. Playing pieces (not shown) on the surface 2 are pushed towards the edges of the surface 2 by the pusher 4.

In use, a player causes additional playing pieces to be added to the surface 2 in the hope that these additional playing pieces will cause playing pieces to be pushed over win edge region 6.

Figure 3:
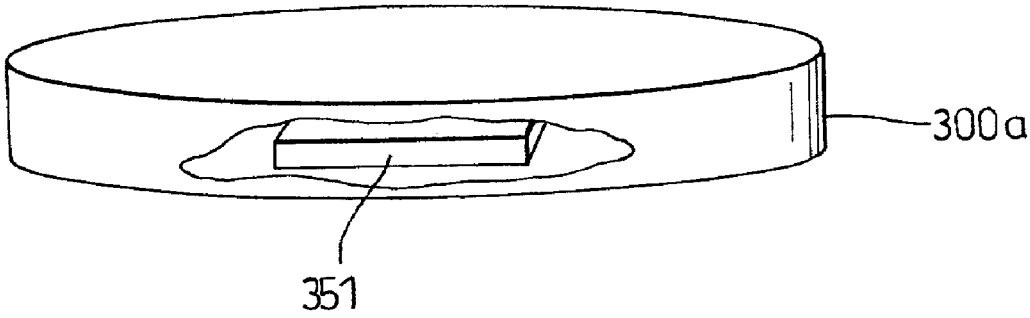
FIG. 3 shows a first playing piece according to embodiments of the invention.

In this embodiment the first playing pieces are discernible from the second playing pieces as they are a different colour and have an integrated circuit embedded therein. The integrated circuit is detected by the playing piece detecting means 102 when the first playing pieces pass over the win edge region 6. The playing piece detection means 102 also counts all of the playing pieces passing therethrough and therefore, in this embodiment, functions as a playing piece counter. The different colour of the playing pieces allows a player to readily discern whether or not a first playing piece is near to the win edge region 6. A first playing piece 300*a* is shown in FIG. 3. The playing piece is fabricated from a plastics material and has an integrated circuit 351 provided therein.

The number of second playing pieces within the closed loop is greater than the number of first playing pieces. In one embodiment the playing pieces are similarly dimensioned discs of similar size to coins, fabricated from a plastics material. However, in other embodiments coins may be used instead of the playing pieces.

In use, a player places a coin into coin slot 28, which is validated by coin validator 104. If the coin is valid a signal is sent to the control system 111 and the coin drops into coin dispenser 16. The control device 111 provides the player with a credit, which they can use to release a playing piece onto the surface 101. When the player presses a button on the machine the coin dispenser 16 releases an additional playing piece which drops onto the surface 101. This additional playing piece is simply the next playing piece provided to the playing piece dispensing means 16 by the escalator 105, and it may be a first, or second playing piece on a random basis. Because there are more second playing pieces within the closed loop it is of course more likely to be a second playing piece that is dispensed onto the surface 101.

The pusher 4 pushes the additional playing piece in a general direction of the win edge region 6. The additional playing piece contacts other playing pieces which are already on the surface 101 which are disturbed by the additional playing piece. This disturbing of the playing pieces on the surface 2 may cause playing pieces to fall over the win edge region 6, or the losing edge regions 12.

Any playing piece which pass over the win edge region 6 of the surface 2 are collected by the win chute 99 and are passed for detection by the playing piece detecting means 102. The detecting means 102 sends a signal to the control system 111 indicating the number of first playing pieces and the number of second playing pieces which have passed over the win edge region 6 of the surface 101. The control system 111 sends signals to the coin dispensing device 16 and causes a coin to be dispensed to the win hopper 22 for every second playing piece that has passed over the win edge region 6. Further, the control system 111 sends a signal to the prize dispensing device 110 and causes a prize to be dispensed for every first playing piece that has passed over the win edge region 6. Playing pieces that fall over the losing edge regions 12 do not enter the playing piece detection means 102 and are simply entered back into the escalator by the lose chute 103, after being counted. This embodiment of the invention therefore provides a coin pusher type entertainment machine having a closed loop, which can have playing pieces of different values.

In another embodiment the prize dispenser 110 issues tickets or tokens, which can be taken to a prize collection point external to the entertainment machine and exchanged for the award. In a further embodiment a player can collect many tickets which accumulate so as they can be exchanged for more desirable prizes, or the machine may provide points to a win bank, or account, that can be exchanged for a prize at a later time.

Figure 4:
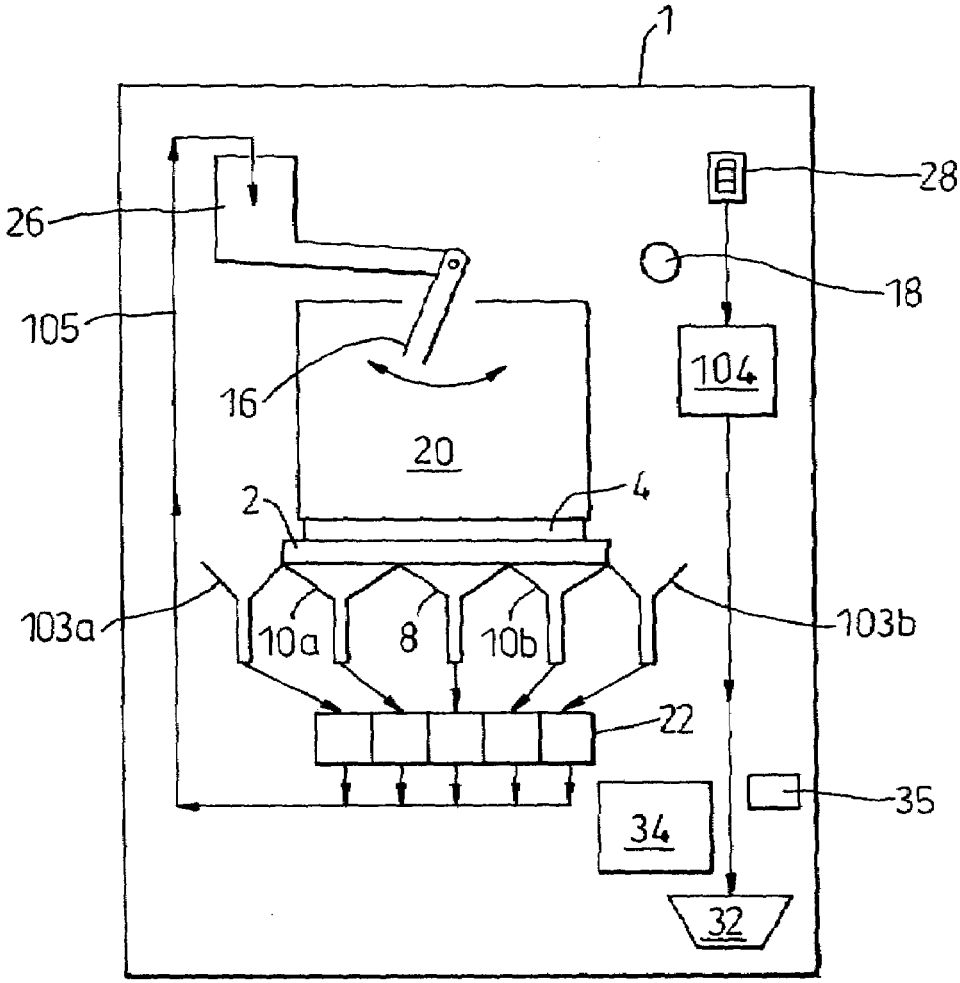
FIG. 4 shows an entertainment machine according to one embodiment of the invention.
Figure 5:
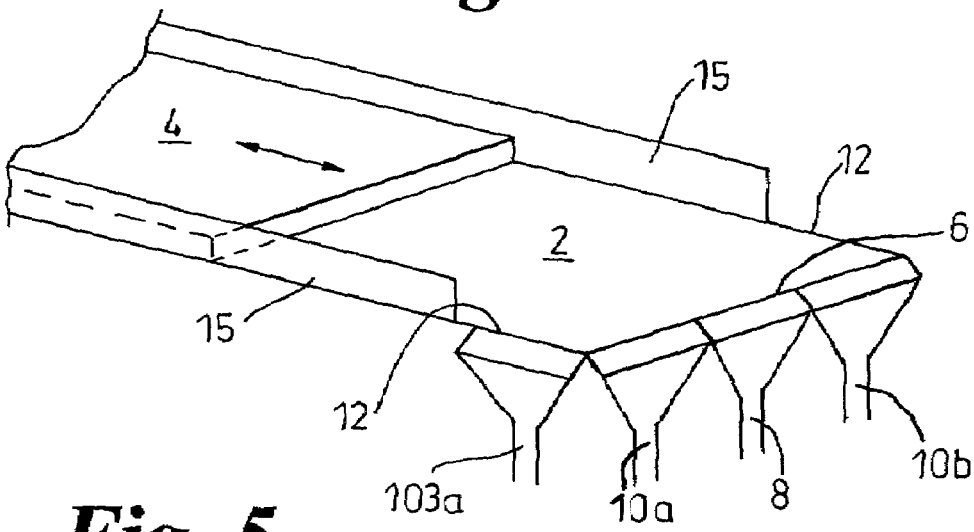
FIG. 5 shows a playing field and pusher of the machine according to the embodiment of FIG. 4.

The machine of FIG. 4 is of the type known as a coin pusher and shares many of the features of the machine shown in FIG. 1. Common features are therefore labelled with like numbers. In this embodiment, at a front edge 6 of the playing surface 2 there are provided three "win" chutes 8, 10*a*, 10*b*, and at each of the side edges 12 of the playing surface 2 there is provided a "lose" chute 103*a*, 103*b*. The win 8, 10*a*,10*b* and lose 103*a*, 103*b* chutes are each arranged to catch playing pieces falling over an edge. Side walls 15 are provided at edge regions of the playing surface to contain the playing pieces where there is no chute to collect them. The detail of this arrangement can be seen in FIG. 5.

A directional playing piece dispenser 16 is provided above the playing surface 2 and an outlet thereof is arranged to oscillate over an arc of roughly 90°, such that when playing pieces are released therefrom they fall from a random point towards the playing surface 2. A player presses a playing piece release button 18 to release a playing piece from the dispenser, which falls into a substantially vertical transparent region 20, comprising, in this embodiment, two parallel sheets of material spaced such that there is a gap between them just larger than a playing piece's thickness. At its lower end, the transparent region 20 is open to allow playing pieces to fall onto playing surface 2.

The win 8, 10*a*, 10*b* and lose 103*a*, 103*b* chutes are connected to hoppers 22, such that playing pieces falling from the playing field pass through the chutes and into the relevant hopper. Each of the hoppers connected to a chutes 8, 10*a* 10*b*, 103*a*, 103*b* include a counting means and/or a detecting means for counting and/or detecting playing pieces entering into the hopper. The hoppers are connected to a transfer means, in this case, an escalator 105, which raises the playing pieces to a storage container 26 connected to the playing piece dispenser 16.

A coin slot 28 for receiving coins is connected to a coin validator 104. A coin store 32 is also connected to the coin validator 104 so as to allow coins to pass from the coin slot 28 through the coin validator 104 and into the store 32.

The validator 104 determines the value of the coins entered into the coin slot 28 and converts this value into a number of credits which are displayed in a display window 34. When the playing piece release button 18 is pressed, the number of credits displayed in the display window 34 is decremented by a predetermined amount.

A "win" button 35 is provided to allow a player to collect his/her winnings.

Figure 7:
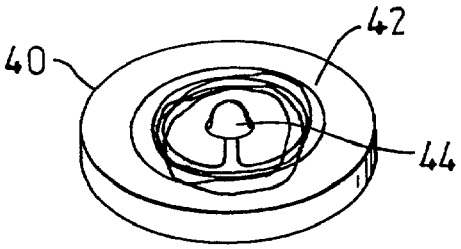
FIG. 7 shows a playing piece containing electronics according to one embodiment of the invention.

FIG. 7 shows a disc like variable appearance playing piece 40 containing a receiving coil 42, a light emitting diode (LED) 44 and additional electronics (not shown) to control the function of the LED. An LED 44 is associated with both sides of the playing piece so that the output of at least one of the LED's is visible no matter which way up the playing piece is lying.

The receiving coil 42 and the additional electronics can be combined to provide a decoder that can receive instructions to a specific playing piece, or group of playing pieces. Providing the ability to issue instructions to a specific playing piece allows that playing piece to be controlled in a different manner to others. The machine also contains a plurality of playing pieces that have roughly the same physical dimensions and appearance as the variable appearance playing pieces 40, but which do not contain the LED.

Figure 8:
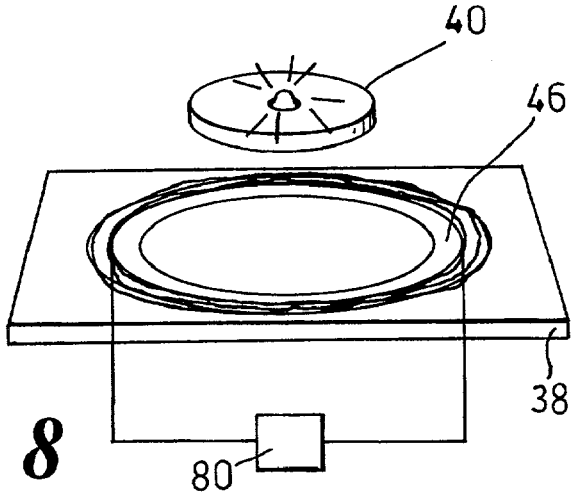
FIG. 8 shows a coil in a transmitter and the playing piece of FIG. 7 adjacent the transmitter.

An appearance controlling means can be provided using known Radio Frequency Identification Device (RFID) technology (shown schematically in FIG. 8 for one of the transmitters 38) in which a current in a coil 46 produces a local magnetic field, providing a power signal, to which a playing piece 40 placed above the transmitter can take power therefrom (the magnetic field inducing a current in an inductor within the playing piece).

Suitable RFID transponders for use in the playing pieces can be obtained from companies such as Destron-Fearing, Temic, Texas Instruments, etc.

To use the additional electronics a high frequency signal is modulated onto the power signal produced by the coil 46. This high frequency signal is filtered from the power signal by the electronics within the playing piece 40 and can be decoded to control the LED 44 as desired. The frequency of the high frequency signal may itself provide the instructions; i.e. a signal received at a predetermined first frequency may indicate a first action should be performed, and a signal received at a second predetermined frequency may indicate that a second action should be performed. In a second embodiment the high frequency signal may include instructions and allow individual playing pieces to be specifically addressed, and provided with individual instructions.

Figure 6:
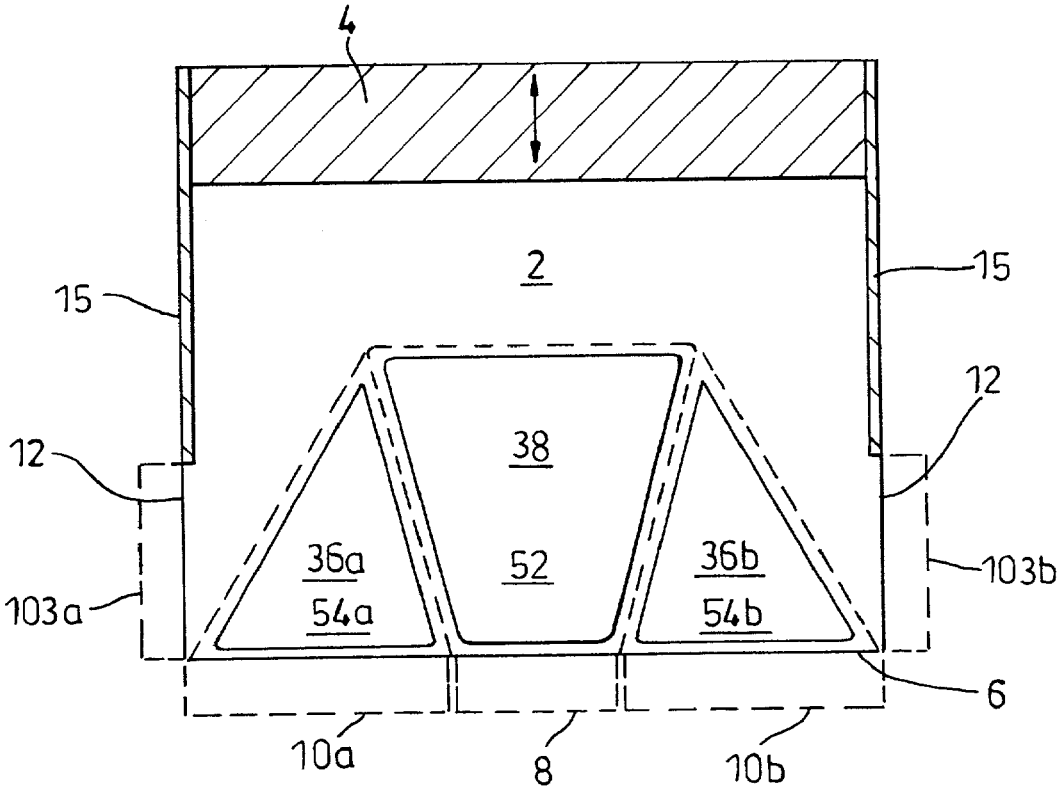
FIG. 6 shows a surface divided into regions controlled by transmitters beneath the surface according to one embodiment of the invention.

In one embodiment, which can be seen in FIG. 6, the playing surface 2 is divided into a high value region 52, and two low value regions 54*a*, 54*b*. The high value region 52 is associated with a high value transmitter 38 transmitting a power signal modulated at a first frequency, and the two low value regions 54*a*, 54*b* are associated with low value transmitters 66*a*, 36*b* transmitting a power signal modulated at a second frequency. The transmitters are constructed so that the signals transmitted therefrom provide regions above them have of the desired shape.

When a variable appearance playing piece 40 receives the signal from the high value transmitter 38 it flashes, whereas when a playing piece 40 receives a signal transmitted from a low value transmitter 36*a*, 36*b* it continuously lights. Therefore, it is the frequency of the modulated signal that is used to contain the instructions for any playing piece 40 receiving that signal. The different lighting of the playing pieces provides a difference of appearance that indicates to a player that the respective playing pieces will have different values when they fall from the playing surface 2.

It will be seen from the shape of the regions in FIG. 6 that playing pieces progressing generally towards "lose" chutes 103*a*, 103*b* are not lit as there is no transmitter directly beneath the playing surface 2 in those areas, and therefore, the machine is arranged such playing pieces in these regions do not receive a power signal, nor a signal modulated onto the power signal.

Figure 9:
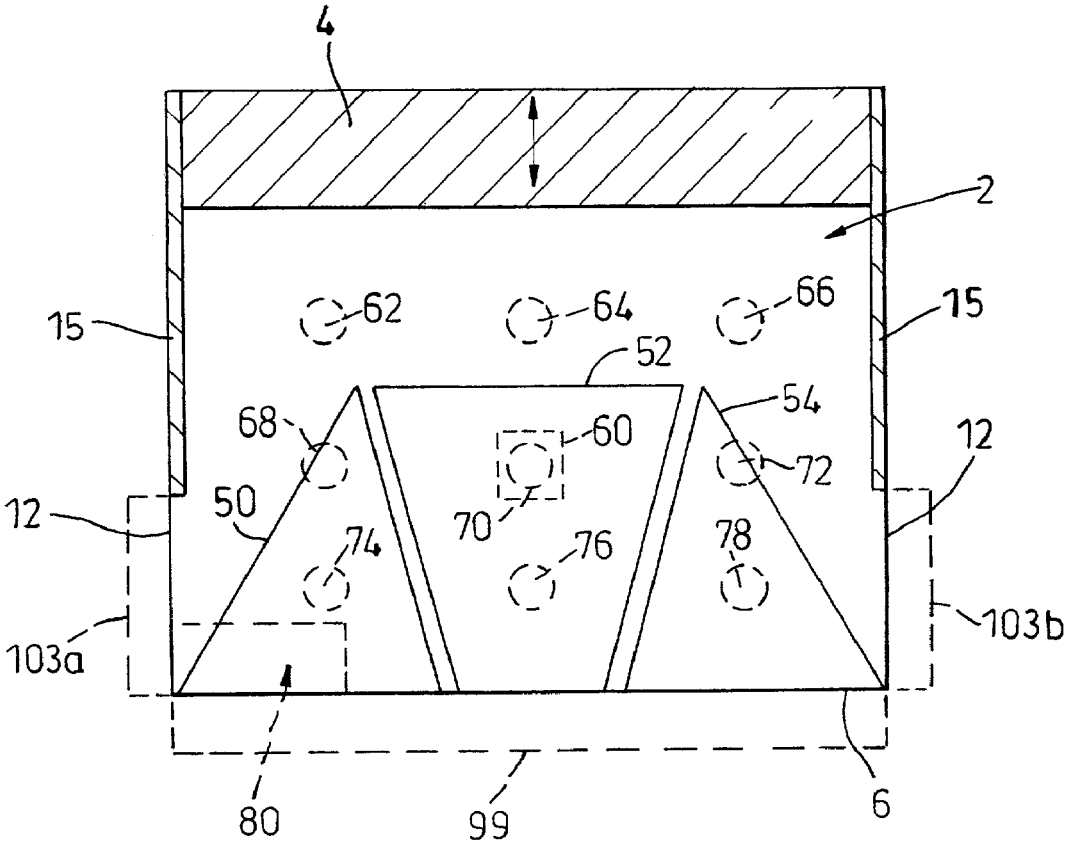
FIG. 9 shows an alternative embodiment of the machine to that shown in FIG. 6.

Another embodiment relying on addressing individual playing pieces is described in relation to FIG. 9. Parts are the same as those described elsewhere are referred to with the same reference numerals. Underneath the playing surface 2 there is provided a single transmitter 60 capable of transmitting a power signal to power any variable appearance playing pieces 40 present on the playing surface 2. Control circuitry 80 is provided and controls the signal being transmitted by the transmitter 60. Further, nine separate receivers 62, 64, 66, 68, 70, 72, 74, 76, 78, provided underneath the playing surface 2.

Each receiver 62–78 is connected to the control circuitry 80, and passes signals that have been received thereto, together with a measure of the strength of each signal.

In use, each variable appearance playing piece 40 has an individual, unique, address. The control circuitry 80 can modulate the power signal transmitted by the transmitter 60 to be specific to a predetermined one of the individual variable appearance playing pieces 40. That is, the signal is modulated according to a predetermined protocol, such that the signal contains a unique address, followed by a command. Further, as is known in the field of RF identity tags, each variable appearance playing piece can transmit its own signal, which can be received by any one of the receivers 62–78. (The energy obtained from the transmitted power signal is used by the electronics within the playing piece to drive the coil 42 to transmit a signal. The signal transmitted by a playing piece 40 contains the unique address of the playing piece, so that control electronics can determine from which playing piece 40 the signal has been received from.)

Because there are a plurality of receivers signals transmitted from a variable appearance playing piece 40 will be received by more than one receiver 62–78. The control circuitry 80 determines from the identity imposed on the received signal together from the signal strength of each received signal the identity and location of the variable appearance playing piece 40 that transmitted the signal. Therefore, as that variable appearance playing piece 40 moves across the playing surface 2 its location can be tracked.

The high value region 52 and the two low value regions 54*a*, 54*b* of the bed that were described in relation to FIG. 6 are shown in FIG. 9. In the embodiment of FIG. 9 as a variable appearance playing piece 40 moves into a region instructions are issued to that particular playing piece by the control circuitry 80 to cause it flash, or illuminate appropriately. For example as a variable appearance playing piece 40 moves into a low value region 54*a*, or 54*b* then it is caused to continuously light, whereas if a variable appearance playing piece 40 moves into the region 52 it is caused to flash.

It will be appreciated that because the location of each variable appearance playing piece 40 on the playing surface 2 is known there is no need to have a plurality of win chutes as was necessary in the embodiment of FIG. 6. A single win chute 99 is provided, and the control circuitry determines whether the variable appearance playing piece 40 fell from the playing surface 2 from the high 52 or either of the low value 54*a*, 54*b* regions according to its known position.

In use, a player places a coin into the coin slot 28, which is validated and sorted for pay out by the coin validator 104. The player is provided with a credit displayed in the display window 34. If the credit level is above a predetermined amount, an extra playing piece is released from the playing piece dispenser 16 when the playing piece release button 18 is pressed. The playing piece passes through the transparent region 20 and drops onto the playing surface 2.

This additional playing piece is introduced in the hope that it will cause a playing piece near front edge 6 to fall into a "win" chute through the motion of the pusher 4 pushing the extra playing piece into those already on the playing surface 2. Playing pieces progress generally towards the front edge 6, but may also progress towards side edges 12 and fall into "lose" chutes 103*a*, 103*b*.

In embodiments where the playing surface 2 is divided into regions the front edge 6 is divided into score regions such that playing pieces which fall into "win" chute 8 score more credits than those that fall into "win" chutes 10*a*, 10*b*. To heighten the player's anticipation of a scoring event, playing pieces are visibly distinctive in a first manner, e.g. flash if it seems more likely from their position on playing surface 2 that they will fall into "win" chute 8 and visibly distinctive in a second manner, e.g. continuous illumination, if it seems more likely that they will fall into "win" chutes 10*a*, 10*b*.

Any playing piece which falls into a "win" chute is counted and converted into credits at a predetermined conversion rate. The conversion rate is higher for playing pieces which have fallen into "win" chute 8 than for playing pieces which have fallen into "win" chutes 10*a* or 10*b*. The credit level displayed in display window 34 is increased by a corresponding amount.

Playing pieces which fall into any chute are, after counting, transferred to escalator 105 and into the storage container 26, ready for recirculation.

The game ends either when the player has insufficient credits to exchange for a playing piece or the player chooses to cash out by pressing button 35 and collecting the coins dispensed from the store 32.

The RFID technology discussed above provides the possibility of instructing an individual playing piece or group of playing pieces to behave in a particular way. The decoder can either respond differently to different signal frequencies or can respond only when that playing piece is specifically addressed. From time to time, all or a portion of the playing pieces on the playing field could be caused to flash, if they are variable appearance playing pieces, or change their appearance in another way.

In a further example, a playing piece may be visibly identifiable from the time it falls onto the playing surface 2 and may maintain that identity whilst it traverses the field until if falls from an edge of the playing surface 2, rather than having its visual appearance change as it moves through different regions of the playing surface 2, or temporal periods.

Figure 11:
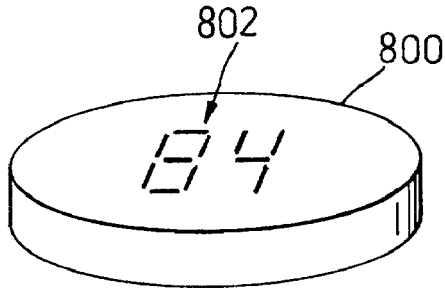

In alternative embodiments, which may utilise RFID technology, the LED may be replaced by a seven-segment display, an LCD, or some other electronically controllable display means. An example of such a playing piece is shown in FIG. 11 wherein a variable appearance playing piece 800 has two seven segment displays 802 at a central region thereof.

Figure 10:
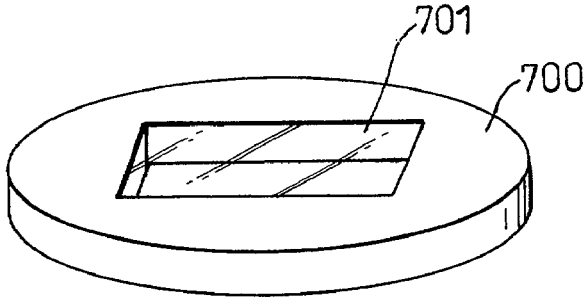
FIGS. 10 and 11 shows a further embodiment of a playing piece for use in the entertainment machine of FIG. 4.

In alternative embodiments, which do not necessarily rely on RFID technology, the playing pieces on the playing field may be made to have a different visual appearance from one another. For example, the playing surface 2 is wholly or partially translucent, and is lit from beneath by different coloured lights. Translucent or partially translucent playing pieces, as shown in FIG. 10, are used, and thus the light visible through the playing piece or portion of playing piece depends on their position on the playing surface. The playing piece 700 has a transparent, or translucent window 701 at a central region thereof.

Different regions of the playing field may be illuminated with different coloured lights. Further, only some of the playing pieces may allow light to pass therethrough, or may contain different coloured filters so that different playing pieces appear a different colour within the same region.

In some embodiments there may be translucent playing pieces, which contain a red light filter, so that, when lit with white light it appears red. Other playing pieces may contain blue light filters and so appear blue.

In some embodiments the variable appearance playing pieces comprise reflective portions and the playing field is lit from above by light sources emitting visible light. Other non variable appearance playing pieces which do not contain reflective portions are also provided. Therefore, the appearance of the variable appearance playing pieces may be controlled by the controlling the light sources, which provide an appearance controlling means.

The playing field need not be divided in any way and the whole surface may be associated with a single transmitter or light source.

Other embodiments may use electromagnetic radiation other than visible light, and ultra-violet (UV) light may be particularly suitable. Where the light source is a UV light source, a further type of playing piece that responds to UV light, such as by glowing, is included in the machine. Playing pieces that respond to other types of electromagnetic radiation, such as by fluorescing, may be used together with that type of radiation a seven-segment display, an LCD screen, or some other means.

Further embodiments may use thermal radiation from a heating device, and a further type of playing piece, which changes its appearance, such as colour or shape, in response to the temperature of the surroundings.

In yet further embodiments playing pieces having the electronics discussed in relation to FIG. 7 may be used and RFID controlled playing pieces could maintain a single display for the duration of their time on the playing surface e.g. continuously flash at a predetermined rate.

Figure 12:
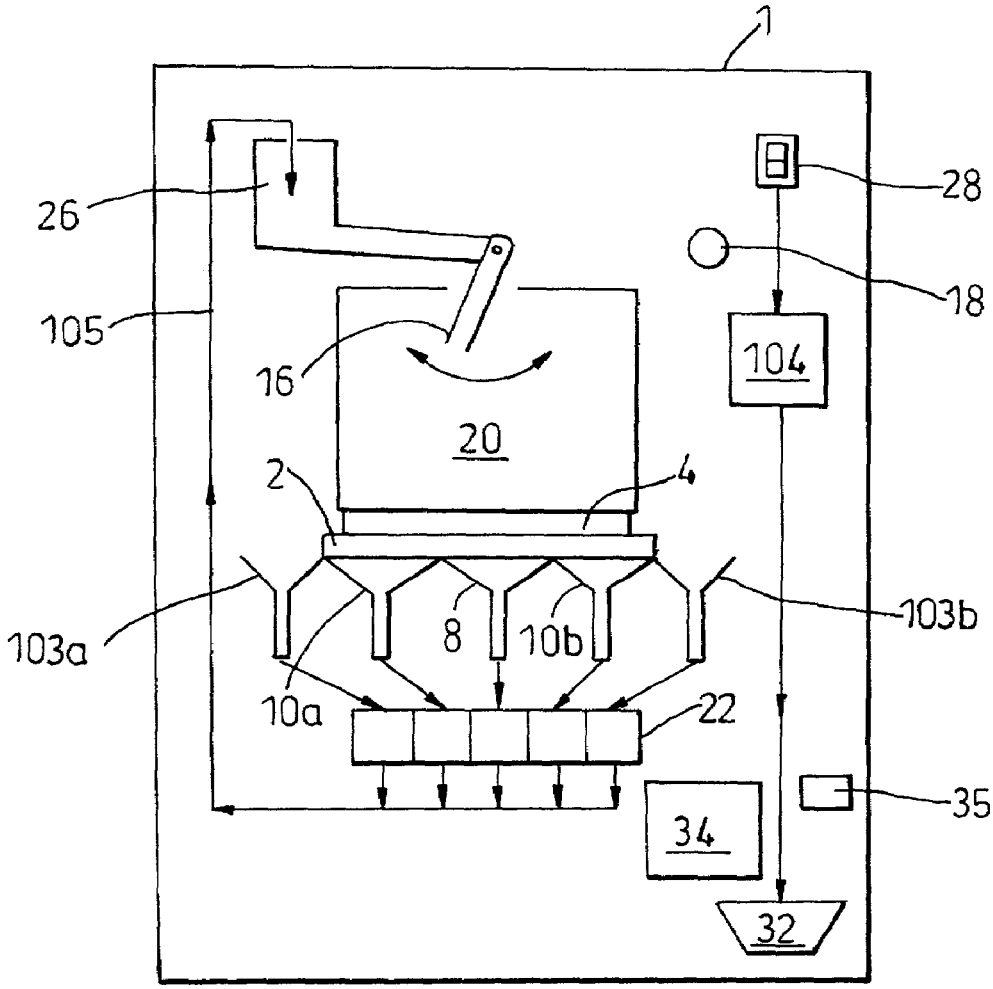
FIG. 12 shows an entertainment machine according to one embodiment of the invention.
Figure 13:
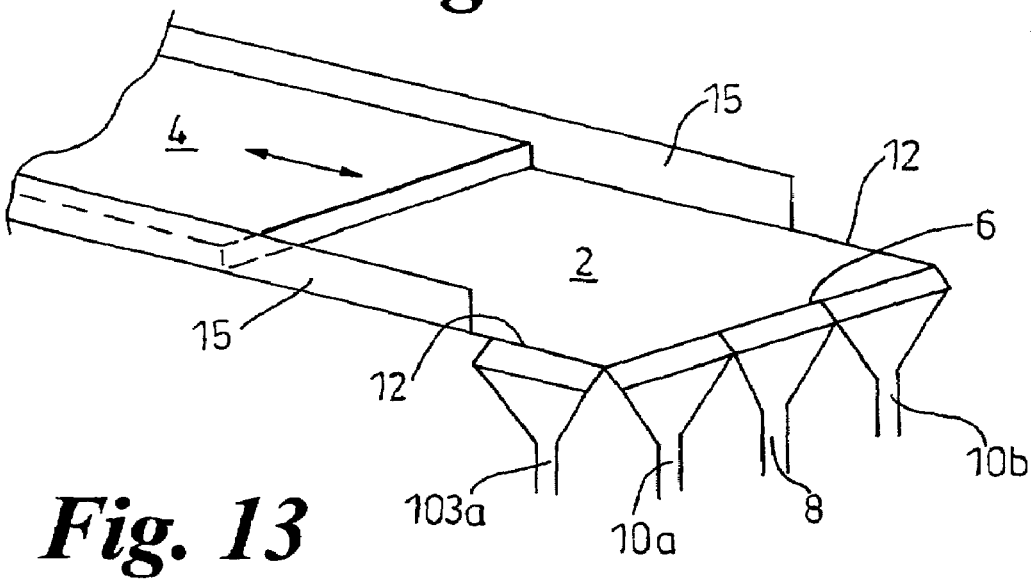
FIG. 13 shows a playing surface and pusher of the machine according to the embodiment of FIG. 12.

The machine of FIG. 12 (shown in greater detail in FIG. 13) is similar to that shown in FIG. 4 and like features are labelled with like numbers. However, in this embodiment, the counting/detecting means includes a reader for reading identifiers associated with playing pieces.

Figure 15:
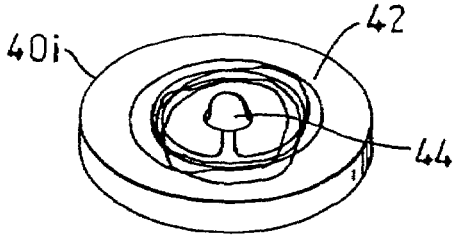
FIG. 15 shows a token containing electronics.

FIG. 15 shows an entertainment machine playing piece 40*i* similar to that shown in FIG. 7 and like components are labelled with like numbers. In this embodiment, the playing piece 40i is an identifiable playing piece containing a receiving coil 42, a light emitting diode (LED) 44 and additional electronics (not shown) to control the function of the LED. An RFID tag constitutes at least some of the components within the identifiable playing piece 40*i*, and provides an identifier. The receiving coil 42 and the additional electronics can be combined to provide a decoder that can receive instructions to a specific playing piece, or group of playing pieces. Providing the ability to issue instructions to a specific playing piece allows that playing piece to be controlled in a different manner to others. The machine also contains a plurality of playing pieces that have roughly the same physical dimensions and appearance as the identifiable playing pieces 40*i* shown in FIG. 15, but which do not contain the receiving coil, the LED, nor the electronics.

The counting/detecting means provided in each of the hoppers 22 are capable of reading any identifiable playing pieces that pass therethrough. In the embodiment described the counting/detecting means comprises a receiver capable of reading the RFID device within an identifiable playing piece 40*i*. However, other mechanisms may be possible.

Figure 16:
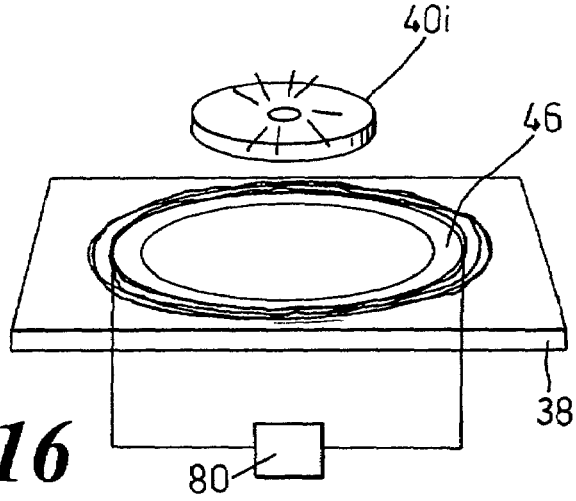
FIG. 16 shows a coil in a transmitter and the token of FIG. 15 responding to a signal produced by the transmitter.

A reader capable of reading identifiable playing pieces 40*i* can be provided using known Radio Frequency Identification Device (RFID) technology (shown schematically in FIG. 16 for one of the transmitters 38) in which a current in a coil 46 produces a local magnetic field, providing a power signal, to which an identifiable playing piece 40*i* placed above the transmitter can take power therefrom (the magnetic field inducing a current in an inductor within the identifiable playing piece 40*i*). To use the additional electronics a high frequency signal is modulated onto the power signal produced by the coil 46. This high frequency signal is filtered from the power signal by the electronics within the identifiable playing piece 40*i* and can be decoded to control the LED 44 as desired. The frequency of the high frequency signal may itself provide the instructions; i.e. a signal received at a predetermined first frequency may indicate a first action should be performed, and a signal received at a second predetermined frequency may indicate that a second action should be performed. In a second embodiment the high frequency signal may include instructions and allow individual playing pieces to be specifically addressed, and provided with individual instructions.

Figure 14:
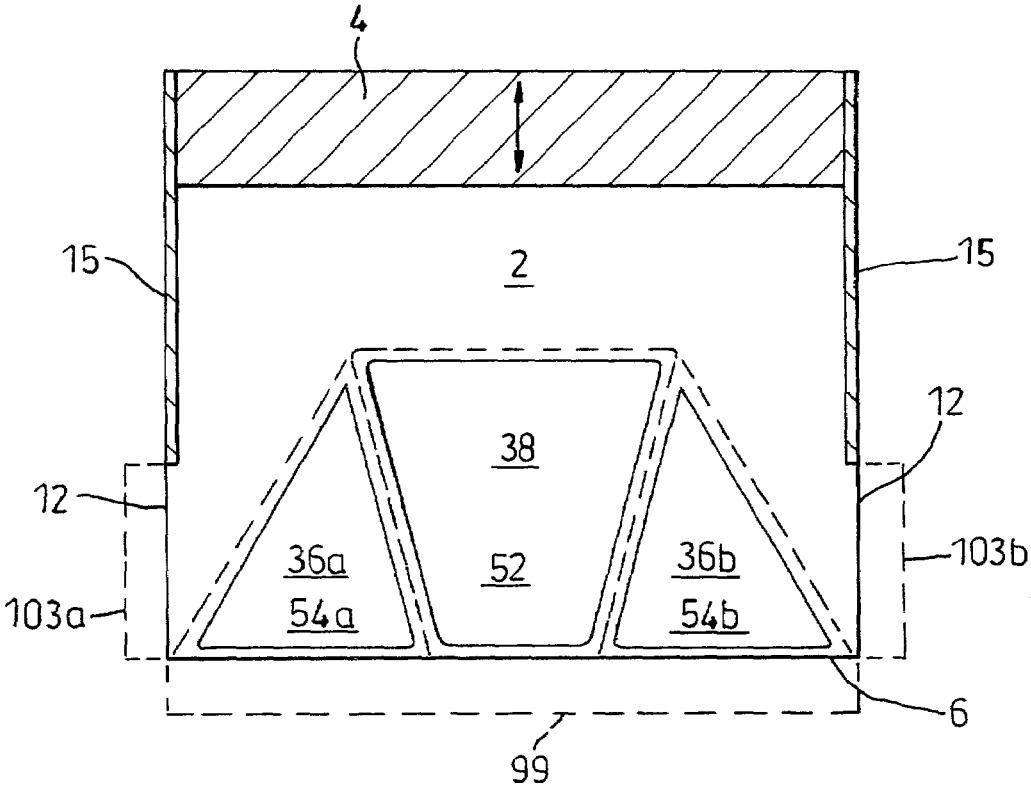
FIG. 14 shows a transmitter beneath a playing surface.

In one embodiment, which can be seen in FIG. 14, the playing surface 2 is divided into a high value region 52, and two low value regions 54*a*, 54*b*. The high value region 52 is associated with a high value transmitter 38 transmitting a power signal modulated at a first frequency, and the two low value regions 54*a*, 54*b* are associated with low value transmitters transmitting a power signal modulated at a second frequency. The transmitters are constructed so that the signals transmitted therefrom provide regions above them have of the desired shape.

When an identifiable playing piece 40*i* receives the signal from the high value transmitter 38, it flashes, whereas when the identifiable playing piece 40*i* receives a signal transmitted from a low value transmitter 36*a*, 36*b* it continuously lights. Therefore, it is the frequency of the modulated signal that is used to contain the instructions for any playing piece 40*i* receiving that signal. The different lighting of the playing pieces provides a difference of appearance that indicates to a player that the respective playing pieces will have different values when they fall from the playing surface 2.

It will be seen from the shape of the regions in FIG. 14 that playing pieces progressing generally towards "lose" chutes 103*a*, 103*b* are not lit as there is no transmitter directly beneath the playing surface 2 in those areas, and therefore, the machine is arranged such playing pieces in these regions do not receive a power, nor signal modulated onto the power signal.

Figure 17:
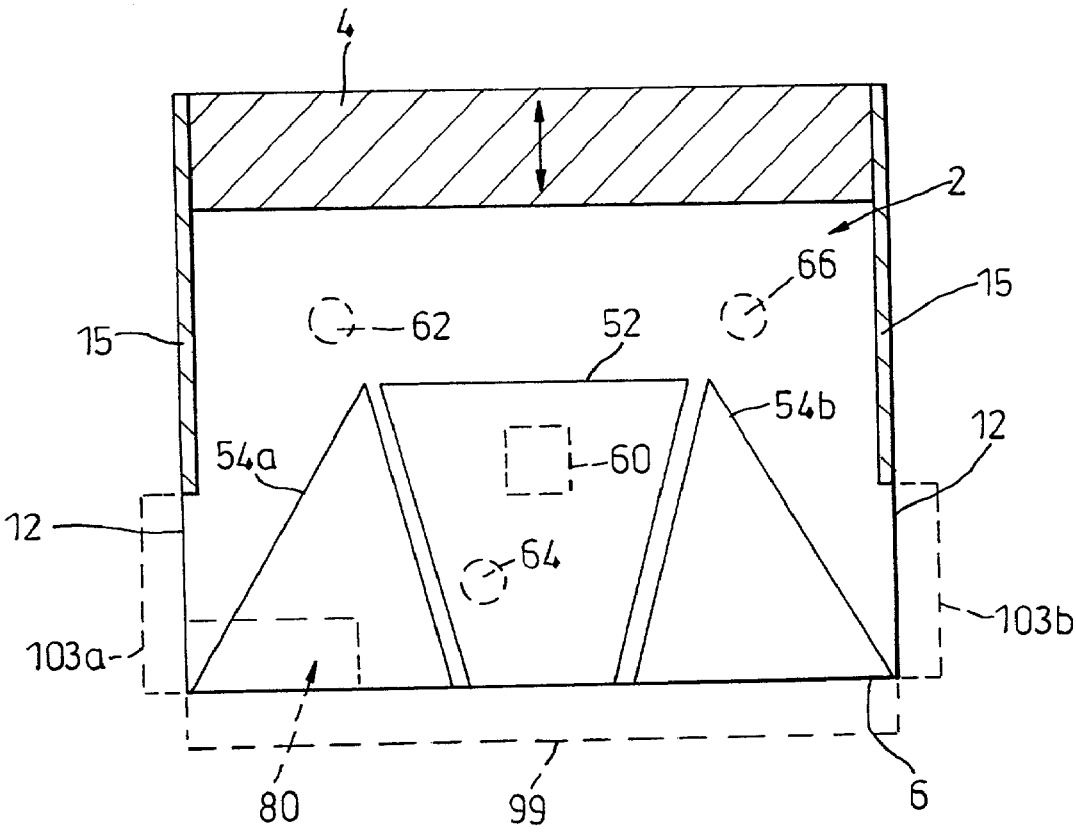
FIG. 17 shows a high value region and two low value regions beneath the playing surface according to FIG. 14.

Another embodiment relying on addressing individual playing pieces is described in relation to FIG. 17. Parts are the same as those described elsewhere are referred to with the same reference numerals. Underneath the playing surface 2 there is provided a single transmitter 60 capable of transmitting a power signal to power any identifiable playing pieces 40*i* present on the playing surface 2. Control circuitry 80 is provided and controls the signal being transmitted by the transmitter 60. Further, three separate receivers 62, 64, 66 are provided underneath the playing surface 2.

Each receiver 62–66 is connected to the control circuitry 80, and passes signals that have been received thereto, together with a measure of the strength of each signal.

In use, each identifiable playing piece 40*i* has an individual, unique, address. The control circuitry 80 can modulate the power signal transmitted by the transmitter 60 to be specific to a predetermined one of the individual identifiable playing pieces 40*i*. That is, the signal is modulated according to a predetermined protocol, such that the signal contains a unique address, followed by a command. Further, as is known in the field of RF identity tags, each identifiable playing piece can transmit its own signal, which can be received by any one of the receivers 62–66. (The energy obtained from the transmitted power signal is used by the electronics within the playing piece to drive the coil 42 to transmit a signal. The signal transmitted by an identifiable playing piece 40*i* contains the unique address of the playing piece, so that control electronics can determine from which an identifiable playing piece 40*i* the signal has been received.)

Because there are a plurality of receivers signals transmitted from an identifiable playing piece 40*i* will be received by more than one receiver 62–66. The control circuitry 80 determines from the identity imposed on the received signal together from the signal strength of each received signal the identity and location of the identifiable playing piece 40*i* that transmitted the signal. Therefore, as that identifiable playing piece 40*i* moves across the playing surface 2 its location can be tracked.

The high value region 52 and the two low value regions 54*a*,54*b* of the bed that were described in relation to FIG. 14 are shown in FIG. 17. In the embodiment of FIG. 17 as a identifiable playing piece 40*i* moves into a region instructions are issued to that particular playing piece by the control circuitry 80 to cause it flash, or illuminate appropriately. For example as a identifiable playing piece 40*i* moves into a low value region 54*a*, or 54*b* then it is caused to continuously light, whereas if a identifiable playing piece 40*i* moves into the region 52 it is caused to flash.

It will be appreciated that because the location of each identifiable playing piece 40*i* on the playing surface 2 is known there is no need to have a plurality of win chutes as was necessary in the embodiment of FIG. 14. A single win chute 99 is provided, and the control circuitry determines whether the identifiable playing piece 40*i* fell from the playing surface 2 from the high 52 or either of the low value 54*a*, 54*b* regions according to its known position.

In use, a player places a coin into coin slot 28, which is validated and sorted for pay out by coin validator 104. The player is provided with a credit displayed in display window 34. If the credit level is above a predetermined amount, an extra playing piece is released from the playing piece dispenser 16 when playing piece release button 18 is pressed. The playing piece passes through transparent region 20 and drops onto playing surface 2.

This additional playing piece is introduced in the hope that it will cause a playing piece near front edge 6 to fall into a "win" chute through the motion of the pusher 4 pushing the extra playing piece into those already on the playing surface 2. Playing pieces progress generally towards the front edge 6, but may also progress towards side edges 12 and fall into "lose" chutes 103*a*, 103*b*.

In embodiments where the playing surface 2 is divided into regions the front edge 6 is divided into score regions such that playing pieces which fall into "win" chute 8 score more credits than those that fall into "win" chutes 10*a*, 10*b*. To heighten the player's anticipation of a scoring event, playing pieces are visibly distinctive in a first manner, e.g. flash if it seems more likely from their position on playing surface 2 that they will fall into "win" chute 8 and visibly distinctive in a second manner, e.g. continuous illumination, if it seems more likely that they will fall into "win" chutes 10*a*, 10*b*.

Any playing piece which falls into a "win" chute is counted and converted into credits at a predetermined conversion rate. The conversion rate is higher for playing pieces which have fallen into "win" chute 8 than for playing pieces which have fallen into "win" chutes 10*a* or 10*b*. The credit level displayed in display window 34 is increased by a corresponding amount.

Playing pieces which fall into any chute are, after counting, transferred to escalator 105 and into the storage container 26, ready for recirculation.

The game ends either when the player has insufficient credits to exchange for a playing piece or the player chooses to cash out by pressing button 35 and collecting the coins dispensed from the store 32.

The RFID technology discussed above provides the possibility of instructing an individual playing piece or group of playing pieces to behave in a particular way. The decoder can either respond differently to different signal frequencies or can respond only when that playing piece is specifically addressed. From time to time, all or a portion of the playing pieces on the playing field could be caused to flash, if they are identifiable playing pieces, or change their appearance in another way.

In a further example, a playing piece may be visibly identifiable from the time it falls onto the playing surface 2 and may maintain that identity whilst it traverses the field until if falls from an edge of the playing surface 2, rather than having its visual appearance change as it moves through different regions of the playing surface 2, or temporal periods.

Another possibility to utilise tokens with a identifiable tokens, is to produce patterns on the playing surface 2. Playing pieces 40*i* containing Leeds could be lit in a star formation or words could be written in lights across the playing field, perhaps in response to a high value win.

Tokens which fall into the chute 8 are, after identification, transferred to escalator 105 and into the storage container 26, ready for recirculation.

The machine of FIG. 18 a perspective view of a pusher. It shares many of the features of the pushers of FIGS. 4 and 12, and like features are labelled with like numbers.

As can be seen from FIG. 20 the machine also comprises a win chute 99 arranged such that a playing piece falling from the winning edge 6 of the playing surface 2 fall thereinto. The win chute 99 is connected to a hopper, or playing piece counter 102, which is arranged to count the number of playing pieces passing therethrough. The machine further comprises lose chutes 304, 306, which are arranged to catch playing pieces falling over the losing edges 12 of the playing surface 2. A further hopper, or playing piece counter 308 is provided to count playing pieces falling into the lose chutes 103*a*, 103*b* from the losing edges 12. Both to the playing piece counters 102, 308 empty into a transfer means, which in this case is a coin escalator 105. The escalator 105, is arranged to elevate playing pieces to the directional playing piece dispenser 16.

The machine provides a coin slot 28, for providing payment which in this embodiment, is in the form of coins. The coin slot 28 is connected to a coin validator 104 which in turn is connected to a controller 314.

The machine further provides a playing piece release button 18, which, when pressed, allows playing pieces to be released from directional playing piece dispenser 16. The playing piece release button provides an input to the controller 314.

A payout collection box 114, from which a player may collect their winnings, if any, is also provided. A coin store 32 is provided between the coin validator 104 and the payout collection box 114 such that coins paid into the coin slot 28 can later be used to award a prize to a player. The coin store 32 has a release mechanism, which is under the control of the controller 314. The coin slot 28, playing piece release button 28 and payout collection box 114 are situated at a convenient user operable height.

Inside to the cabinet, there is further provided a tilt detection mechanism 115, which is arranged to detect when the machine is tilted. In this embodiment, the tilt detection mechanism 115 comprises a wire coil 318 forming the first arm of a switch, with a wire pendulum 320 hanging therethrough. Should the coil 318 and the pendulum 320 come into contact then a tilt is detected. In other embodiments, the tilt detection mechanism 115 could comprise mercury tilt switches, or the like.

The controller 314 also comprises timer 119, which is arranged to record the time that has elapsed since the last time that the machine was played. The last time that the machine was played is taken, in this embodiment, to be the time elapsed since a playing piece was released on to the playing surface 2. (The timer 119 would of course generally be provided by software running on the controller 314.)

In predetermined situations the controller 314 is arranged to cause the dispenser 16 to release playing piece onto the playing surface 2.

In use, a player inserts one or more coins into the coin slot 28 until a desired total payment is made. This will determine the number of playing pieces that can be released from the directional coin dispenser 16 by pressing the playing piece release button 28. Once the player presses the playing piece release button 28 playing pieces are released from the directional coin dispenser 16 into the transparent region 20 and onto the playing surface 2 (as long as the player has sufficient credits). The playing piece release button 18 is connected to the controller 314, which has determined how many coins have been inserted into the coin slot 28 through its connection to the coin validator 104. Thus, the controller only causes the dispenser 16 to release playing pieces if the player has sufficient credit.

One or more playing pieces are released onto the playing surface 2 in the hope that the action of the playing piece pusher 4 on that playing pieces, and on the body of playing pieces already dispersed on the playing surface 2, will cause one or more playing pieces to fall from the winning edge 6 of the playing surface 2 into the hopper 99. Playing pieces which fall into the win chute 99 are counted by the counter 102. The number of playing pieces counted by the counter 102 is used to calculate an award, such as a cash equivalent of the playing pieces, which will form a part of a payout to the player. The objective of a player is to cause more coins to be paid from the payout collection box 114, than they pay into the coin slot 28.

Once the playing pieces have been counted, they will be transferred to the escalator 105, ready for reuse in the machine, by recirculation to the dispenser 16.

In normal use, the player continues to press the playing piece release button 18 until no more playing pieces will be released from the directional playing piece dispenser 16. The player may then either insert more coins into the coin slot 28, or may collect his winnings, if any, from the payout collection box 114.

It is easy to understand that, given the player's objective of obtaining payouts, he/she will be attracted to a machine which looks like it may make a payout with the addition of relatively few playing pieces to the playing surface 2. There are circumstances through which the playing surface 2 or, more particularly a region near the win edge 6 of the playing surface 2, may be sparsely populated with playing pieces, and as such, the machine is likely to seem un-enticing to players. For example, when the machine has first been loaded with playing pieces, their dispersion on the playing surface 2 may not be particularly enticing. Another alternative situation may result if a player tries to physically tilt the cabinet to displace playing pieces from the playing surface. Although many machines are fitted with tilt detection mechanisms 115, and may withhold playing pieces caused to fall in this way, the playing pieces which fall are likely to be those which were in a region of the win edge 6 of the playing surface 2 at the time of the tilting. With these removed, the machine is likely to become unattractive.

If a tilt is detected the controller is arranged to cause the dispenser 16 to dispense playing pieces onto the playing surface 2 until, in this embodiment, ten playing pieces have fallen from the winning edge 6 of the playing surface 2, and are counted by the counter 102. This helps to ensure the playing surface is returned to an enticing state, as it may have been before coins were fraudulently caused to fall from the playing surface.

To safeguard against prolonged periods of unattractiveness, the controller 314 is arranged to release playing pieces onto the playing surface 2, which may be at a steady rate, until a total of, in this example, ten playing pieces fall from the playing surface 2 into the win chute 99, once a predetermined time has elapsed since the machine was played. In this embodiment the predetermined time is thirty minutes. The controller 314 is connected to the counter 102 and thus can determine how many playing pieces have fallen from the win edge 6 and into the win chute 99.

Further, the controller 314 is arranged to detect when the machine is first powered up. After such power up the controller 314 is arranged to cause the dispenser 16 to release playing pieces onto the playing surface 2 until the counter 102 has counted, in this case ten, playing pieces falling over the win edge 6.

Further, an operator can press a button 322 on the controller to cause the controller to fill the playing surface 106 with playing pieces. Once the button 322 is pressed then the controller 314 causes the dispenser 16 to release playing pieces onto the playing surface 2 until, in this embodiment, ten playing pieces have been counted by the counter 102. Such a loading feature may be particularly useful if there are no playing pieces on the playing surface 2, but the machine is loaded with playing piece, which are generally held in the escalator 105.

Figure 19:
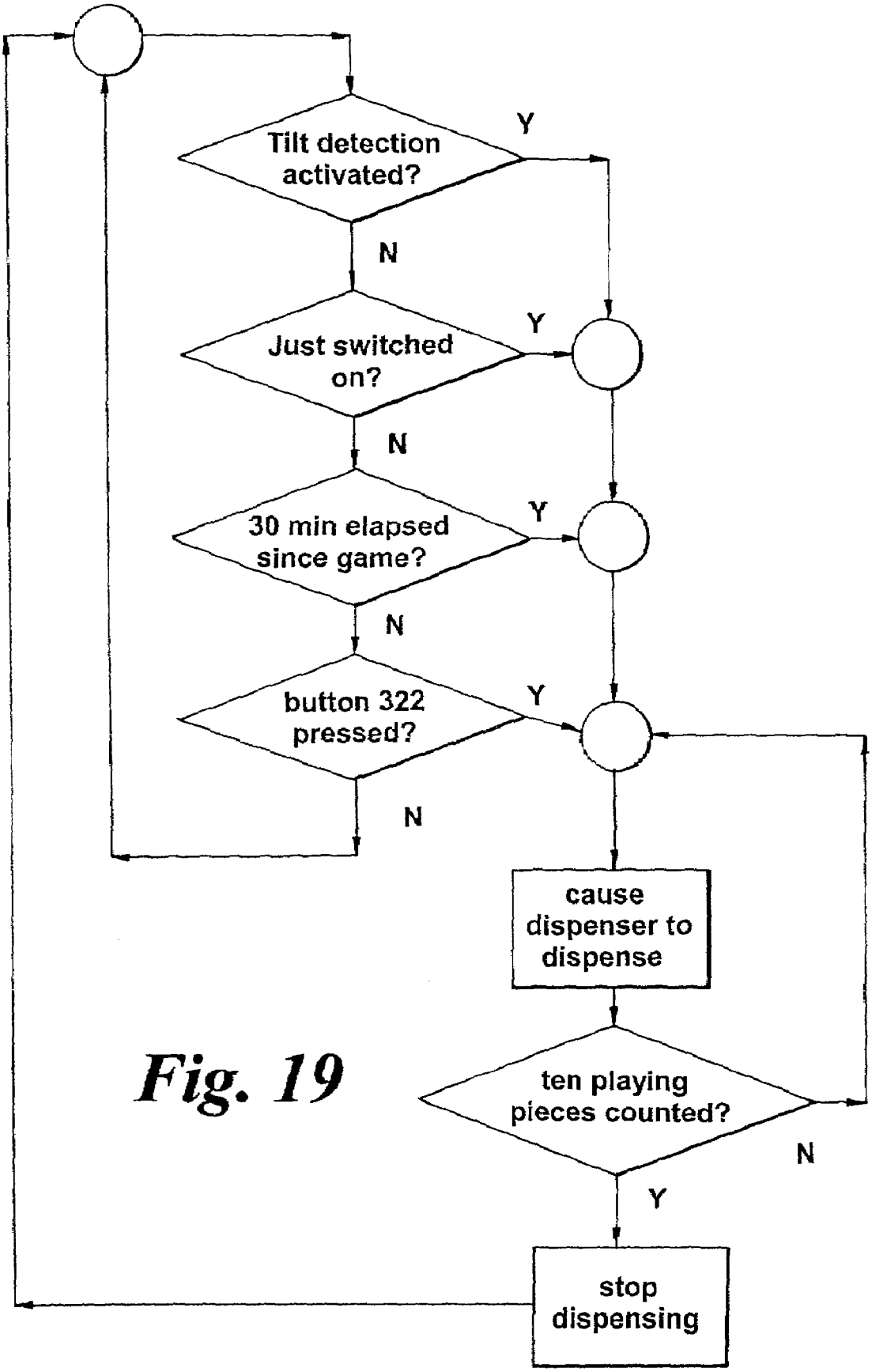
FIG. 19 shows a flow diagram of the functions of the controller within the machine of FIG. 18.

FIG. 19 shows a flow chart showing some of the processes running on the controller 314. If the machine has been tilted 200 and/or the machine has had playing pieces added (i.e. the button 322 has been pressed) 206 and/or the machine has just been turned on 202 and/or if no coins have been paid into the coin slot 204 then the controller causes 208 the dispenser 16 to dispense playing pieces on to the playing surface 2.

Once the counter 102 has counted ten playing pieces the controller 312 ceases to cause the dispenser 16 to dispense playing pieces. Playing pieces which fall from the playing surface in this manner will not contribute to a payout, i.e. the awarding of a prize to a player. The loop shown in FIG. 19 continuously runs whilst the machine is in operation, and aims to keep a sufficient number of playing pieces on the playing surface 2 to keep the machine enticing to players.

FIG. 21 shows a prior art pusher machine, but features in common with the other pushers shown herein have been labelled with like numbers. The pusher comprises a cabinet 1 on which is mounted a coin slot 28, connected to a playing piece dispenser 16 which is open to a generally vertical transparent region 20. The transparent region 20 may be constructed of a Perspex sheet substantially parallel to a rear face of the cabinet, but with a spacing between the sheet and a rear wall of the cabinet 107 just wider than width of a playing piece that will be used in the machine. Alternatively, the transparent region may be constructed of a glass sheet or any other transparent material, or of two sheets of any such material.

The transparent region is open at a bottom region thereof to a substantially flat playing surface 2. A pusher 4 in the form of a stage, or box, is arranged to move cyclically over a portion of the playing surface 2. The transparent region 20, the pusher 4, the dispenser 16 and the playing surface 2 are behind a transparent housing 109, which may be Perspex, glass or any other transparent material. There is also provided a coin collection box 114 from which a player can collect coins that have been paid to them. Inside the cabinet is a playing piece counter 116, which is connected to a controller 314*a*.

The machine further provides a playing piece release button 18 which, when pressed, allows playing pieces to be released from playing piece dispenser 16 onto the playing surface 2. When a playing piece is released, a signal is fed to the controller 314*a*.

A front region of the playing surface 2 comprises a winning edge 6, and the machine is arranged to make an award, or make a contribution to an award, for playing pieces that fall over the winning edge 6. Front portions of side edges comprise losing edges 12, and the machine is arranged such that playing pieces falling thereover do not cause an award, or a contribution to an award, to be made to the player. Fixed side walls 15 extend along the side edges of the playing surface 2 except in the losing edge regions 12. Therefore, playing pieces are prevented from falling from the side edges 12 of the playing surface 2 apart from in a region of the side edges 12.

As can also be seen from FIG. 21, winning chute 99 is provided to catch playing pieces falling over the winning edge 6. The winning chute 99 feeds playing pieces to a playing piece counter 102 (which is commonly referred to in the art as a hopper). Playing pieces falling into the counter 102 fall therethrough into the transfer means 105. In this case the transfer means 105 is a coin escalator. The escalator 105 is arranged to elevate playing pieces to the playing piece dispenser 16. The winning playing piece counter feeds a signal of how many playing pieces have fallen over the winning edge to the controller 314*a*.

Further, a losing chute 103*a*, 103*b* is associated with each of the losing edges 12, although only one can be seen in the Figure. Playing pieces fall through the losing chute 103*a*, 103*b* and into the escalator 105. It will be appreciated that playing pieces passing over the losing edges do not result in an award being made to a player. Of course, in an alternative embodiment, both of the losing chutes 103*a*, 103*b* could feed playing pieces that have fallen over the losing edge 12 to a losing playing piece counter 308, which would then feed a signal of how many playing pieces it has counted to the controller 314*a*.

Figure 22:
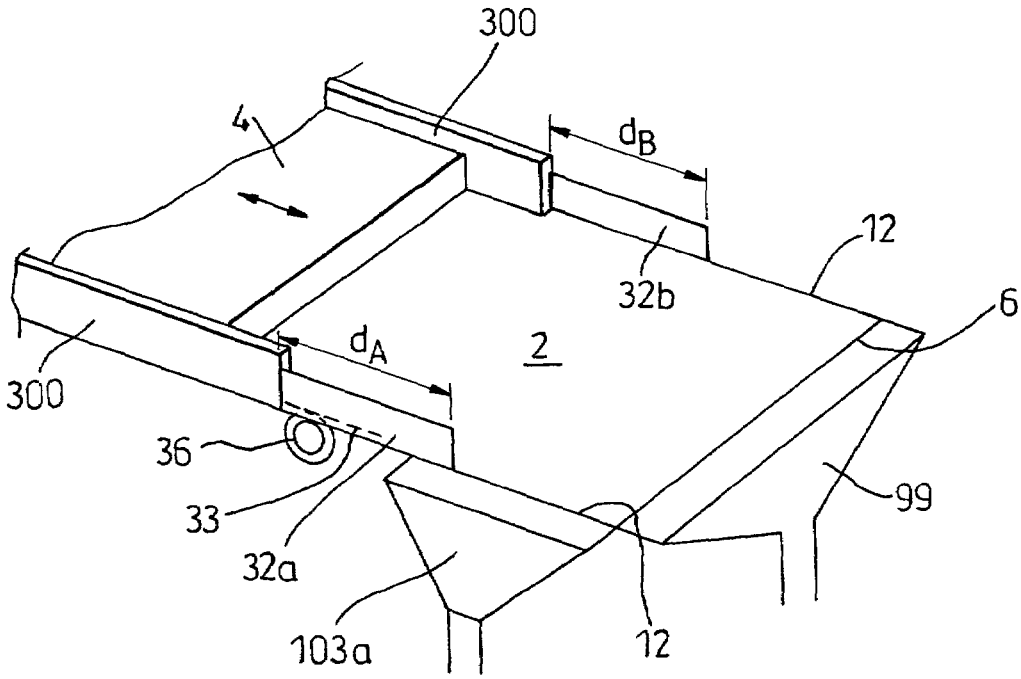

One possible embodiment of the invention is shown in FIG. 22 and parts that are the same as FIG. 21 have been referenced with the same reference numerals. As before, the pusher 4 moves, cyclically, over a portion of the playing surface 2. In FIG. 21 the side walls were of fixed length 15, but in the embodiment shown in FIG. 22 comprise an immovable side wall portions 300 and movable side wall portions 32*a*, 32*b*. These are arranged such that they may be retracted into the immovable side wall portions 300 such that their lengths $d_A$ and $d_B$ may be varied. Again, the embodiment has a winning edge 6 and an associated winning chute 99 arranged such that an object such as a coin, or playing piece, falling from the winning edge 6 would fall into the winning chute 99. In addition, the Figure shows losing edges 12 each with an associated losing chute 103*a*, 103*b*, arranged such that an object such as a coin, or playing piece, falling from the losing edges 12 would fall into the associated losing chute 103*a*, 103*b*.

In this embodiment the movable side wall portions 32*a*, 32*b* each have a rack 33, which meshes with a pinion gear 36 driven by a gear box, in turn driven by a stepper motor. Thus, by driving the stepper motor, the position of the moveable side wall can be altered. Further, in this embodiment the payout corresponds to the number of playing pieces falling from the winning edge 6 and the at least one variable comprises the number of playing pieces falling from the losing edges 12.

Figure 23:
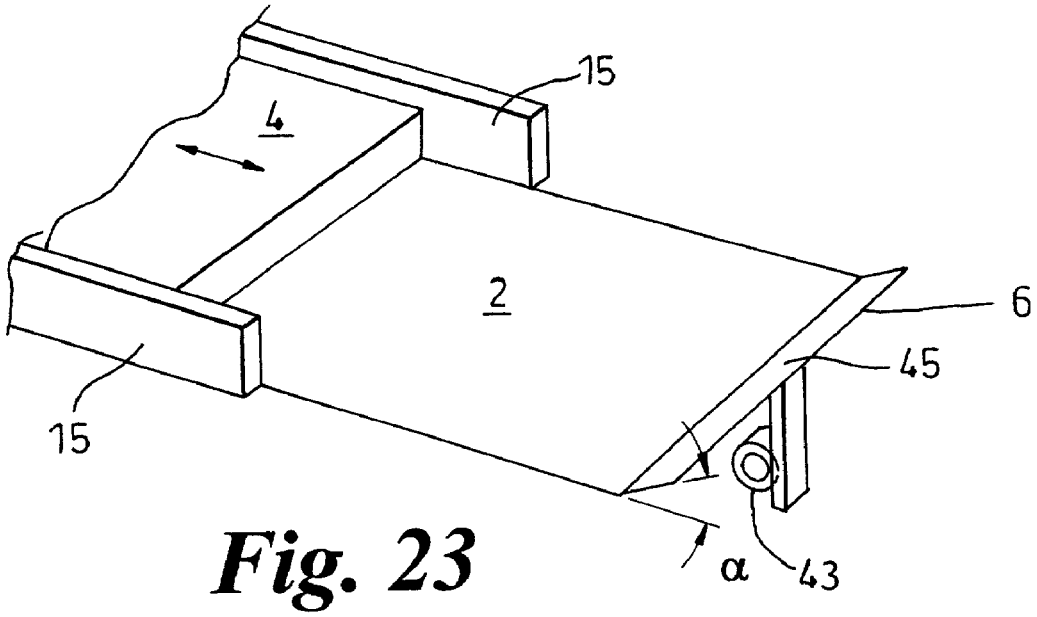

A second embodiment providing a payout controlling means is shown in FIG. 23. Again, the pusher 4 moves over a portion of the playing surface 2, between the immovable side wall portions 15. Although this embodiment of the machine may also include the movable side wall portions 32*a*, 32*b* of FIG. 22, these are not shows for reasons of clarity. The winning edge 6 is positioned on a moveable lip, which in this instance is a hinged lip 45 having a variable angle of elevation $\alpha$.

A rack 41 is pivotally connected to the hinged lip 40, and a pinion gear 43, again driven by a gear box, in turn driven by a stepper motor, is arranged to drive the rack 41. Thus, the angle of the hinged lip 45 can be altered by driving the stepper motor. Again, in this embodiment the payout corresponds to the number of playing pieces falling from the winning edge 6 and the at least one variable comprises the number of playing pieces falling from the losing edges 12.

Figure 24A:
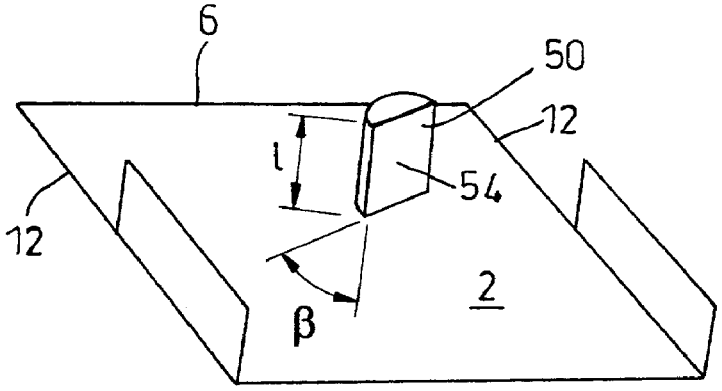

A third embodiment of a payout controlling means is shown in FIG. 24*a*. This shows a controlled protrusion, in this case a profiled stud 50, which protrudes from the playing surface 2. The length l of the stud which protrudes may be varied as may the stud's angle of orientation $\beta$ defined with reference to the playing surface 2. The protrusion 50 has a flat face 54, but otherwise has a curved perimeter.

Figure 24B:
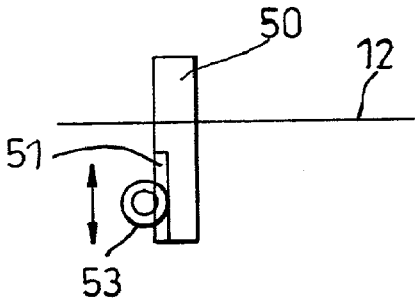

FIG. 24*b* shows how the height of the protrusion may be varied. The protrusion 50 extends below the playing surface, and has a portion thereof formed in to a rack 51, with which a pinion 53 engages. The pinion 53 is driven by a gear box, in turn driven by a stepper motor, and thus the height l of the protrusion can be varied by driving the stepper motor.

Figure 24C:
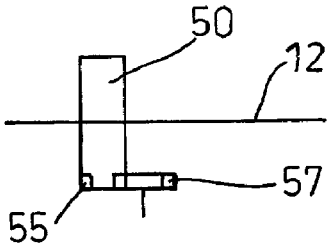

FIG. 24*c* shows an example of how the angle of the protrusion 50 may be varied. A bottom region of the protrusion 50 is formed into a cog 55, which engages a driven cog 57. The driven cog is driven by a gear box, in turn driven by a stepper motor, which can be controlled to alter the angle $\beta$.

Once again, in this embodiment the payout corresponds to the number of playing pieces falling from the winning edge 6 and the at least one variable comprises the number of playing pieces falling from the losing edges 12.

Figure 25:
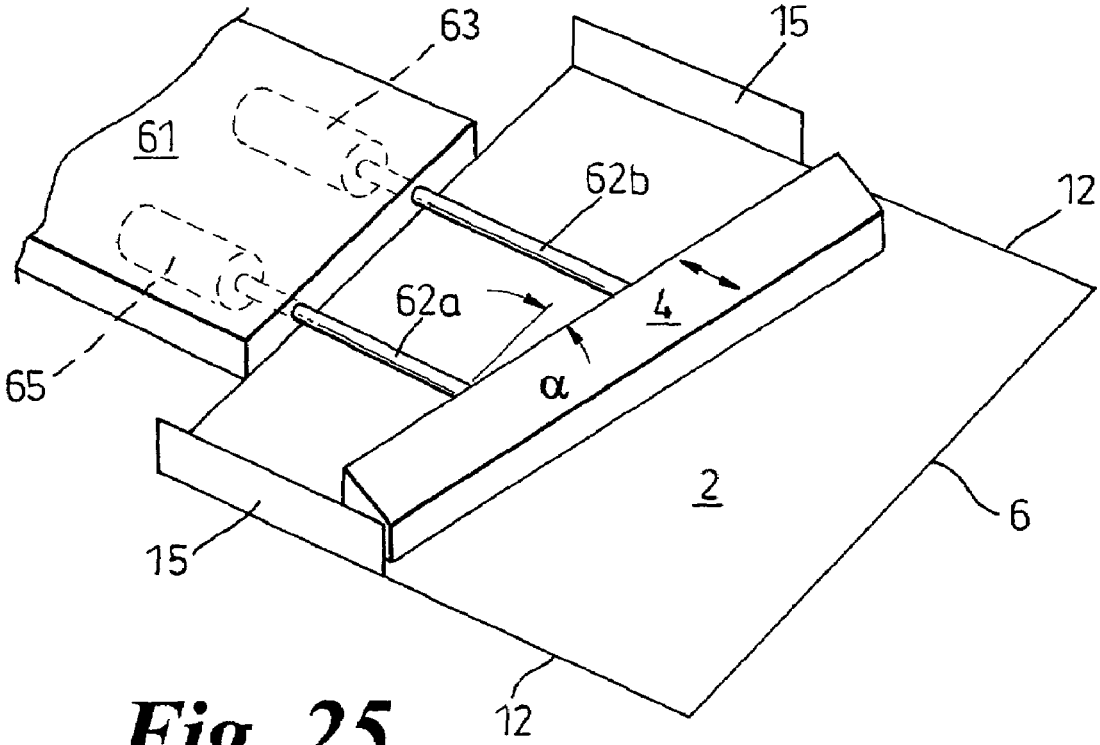

A fourth embodiment of a payout controlling means is shown in FIG. 25. In this example, the pusher 4 moves across a portion of the playing surface 2 and is controlled by a pusher controller 61. The pusher controller 61 is connected to the pusher by two arms 62*a*, 62*b*, and the pusher 4 is oriented relative to the playing surface 2 at an angle $\chi$. The arms are capable of extending variable distances, which may the same for each arm or may be different. If the arms are the same length the pusher 4 will remain substantially parallel to the winning edge 6, and if the arms are different lengths the pusher 4 will not be parallel to winning edge 6, and will be oriented at the angle $\chi$.

Each of the arms 62*a*, 62*b* is driven by pneumatic cylinders 63,65. The pneumatic cylinders are mounted on a platform that reciprocates, thus producing the cyclic motion of the pusher 4. If is desired to alter the angle $\chi$ then one, or other, of the cylinders 63,65 is activated vary the length of the respective arm 62*a*, 62*b*.

Again, in this embodiment the payout corresponds to the number of playing pieces falling from the winning edge 6 and the at least one variable comprises the number of playing pieces falling from the losing edges 12.

Figure 26:
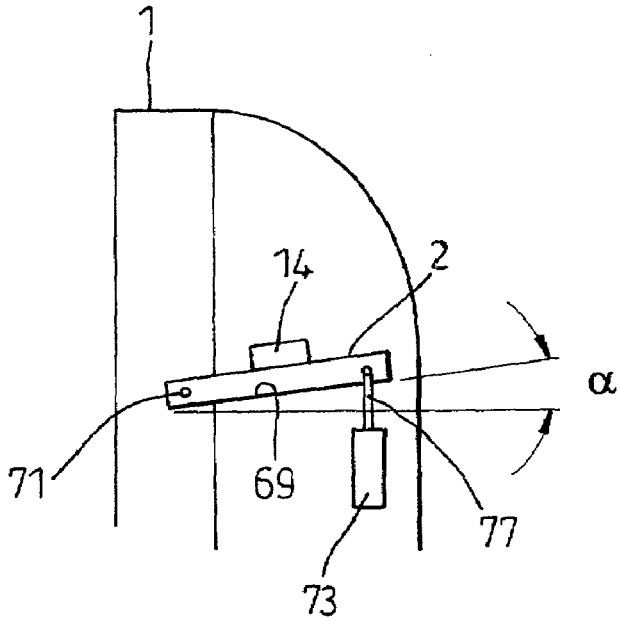

A fifth embodiment of a payout controlling means is shown in FIG. 26. Here, the pusher 4 and the playing surface 2 are mounted on a platform 69 such that the angle of elevation $\delta$ of the playing surface could be altered or it could otherwise alter its orientation to the cabinet 1.

To allow the angle $\delta$ to be varied the playing surface is pivotally mounted 71 to the cabinet 1, and a pneumatic (or hydraulic) ram 73 is used to drive a front region thereof. If it is desired to alter the angle $\delta$ the length of the piston 77 extending from the ram 73 is altered.

In use, a player introduces a playing piece, in this example a coin, but in other embodiments, a playing piece may be a disc-shaped token with an associated monetary value or any other token, into the coin slot 12. This will determine the number of playing pieces that can be released from the playing piece dispenser 16 by the release button 18. A playing piece is released from playing piece dispenser 16, which in this example pivots constantly through an angle of approximately 90° such that the playing piece is released behind the transparent region 20 in a variable manner, and a signal that the playing piece has been released is sent to the controller 314*a*. The playing piece falls through the transparent region 20 and onto the playing surface 2, which already supports a plurality of playing pieces. The playing piece is introduced in the hope that the motion of the pusher 4 on this and other playing pieces will cause the body of playing pieces on the playing surface to move towards and over the winning edge 6. If this occurs, the playing piece or playing pieces that have fallen from the winning edge 6 enter winning chute 99 and are passed through a winning playing piece counter 102 where their value is noted and added to a cumulative winnings total stored in the processor in the controller 314*a*.

Further, the motion of the pusher 4 may also cause playing pieces to fall from losing edges 12 into losing chutes 103*a*, 103*b*. In this embodiment, the playing pieces are passed from the losing chute 103*a*, 103*b* to the transfer means 119. The playing pieces are then passed to the escalator 105 for recirculation.

When the total number of playing pieces that were available for release have been released, the player chooses either to insert more coins into the coin slot 28 and continue playing the machine or to convert the value of the cumulative winnings total into its monetary equivalent, which is deposited into the collection box 114.

In this embodiment the processor in the controller 314*a* calculates the payout parameter. For example, it may have proved desirable to have an 80% payout percentage so that on average for every one hundred playing pieces introduced, eighty fall into the winning chute 99. If it is found that in the time one hundred playing pieces have been introduced, ninety fall into the winning chute 99, the payout parameter will have increased by one thousand and can be considered to have become too high. (The payout parameter is increased by 100 for every playing piece that falls from the winning edge, and is decreased by 80 (the desired payout percentage) for every playing piece that is introduced onto the playing surface. (90×100)−(100×80)=1000). The controller 314a therefore instructs the payout controlling means to compensate for this.

Therefore, turning to the embodiment shown in FIG. 22 the controller causes the moveable side wall portions 32*a*, 32*b* to decrease in length (i.e. $d_A$ and $d_B$ are reduced). This causes the losing edge regions 12 to increase in length, so that there is a higher chance of playing pieces on the playing surface falling thereover. Altering the moveable side wall portions in this manner causes the payout parameter to decrease. Conversely, increasing the length of the moveable side wall portions will increase the payout parameter.

Looking at the embodiment shown in FIG. 23, the angle of the hinged lip 45 is altered to alter the payout ratio. To decrease the payout parameter, as is required in this example, the angle $\alpha$ of the lip 45 is increased. This poses more resistance to playing pieces moving across the playing surface, and therefore, means that the playing pieces are more likely to fall from the losing edges 12. Conversely, to increase the payout parameter the angle $\alpha$ of the hinged lip 45 is reduced so that less resistance is given to the playing pieces moving across the playing surface 2.

To affect the payout percentage in the embodiment of FIG. 24*a* the angle $\beta$ of the protrusion 50 is altered. The flat face 54 faces the origin of the playing pieces and therefore, opposes their motion toward the winning edge 6. The angle $\beta$ affects how the flat face 54 is oriented toward the losing edge regions 12, and may deflect playing pieces toward the losing edges more in some orientations, that others. Further, the length l of the protrusion above the playing surface 2 can be used to affect the payout percentage. As the length l increases more of an obstacle is provided toward playing pieces moving toward the winning edge 6. Therefore, to decrease the payout parameter (i.e. to cause more of the playing pieces introduced to fall from the losing edges 12, or to reduce the playing pieces falling from the winning edge 6) the length l may be increased.

In the embodiment of FIG. 25, the payout ratio can be affected by altering the angle $\chi$ of the pusher 1. As the angle increases playing pieces on the playing surface 2 tend to be pushed more towards the losing edge 12 because there is a component of force imposed by the pusher on the playing pieces that is towards the losing edge 12. Thus as the angle $\chi$ increases the payout parameter decreases.

Further, it is possible to momentarily increase the payout by altering the extent to which the pusher 4 travels across the playing surface 2. That is if the pusher 4 is caused to travel closer to the winning edge 6 on one cycle is will cause a number of extra playing pieces to fall from the winning edge 6.

In the embodiment of FIG. 26, the angle of elevation $\delta$ of the playing surface 2 is controlled to control the payout parameter. As the angle $\delta$ increases there is more resistance to playing pieces moving toward the winning edge 6, and thus they may be more likely to fall from the losing edge regions 12, and the payout parameter decreases accordingly. If the angle $\delta$ decreases (and may even go negative) there is less resistance to playing pieces travelling towards the winning edge 6, they may be less likely to fall from the losing edges 12, and thus the payout parameter may increase.

Figure 27:
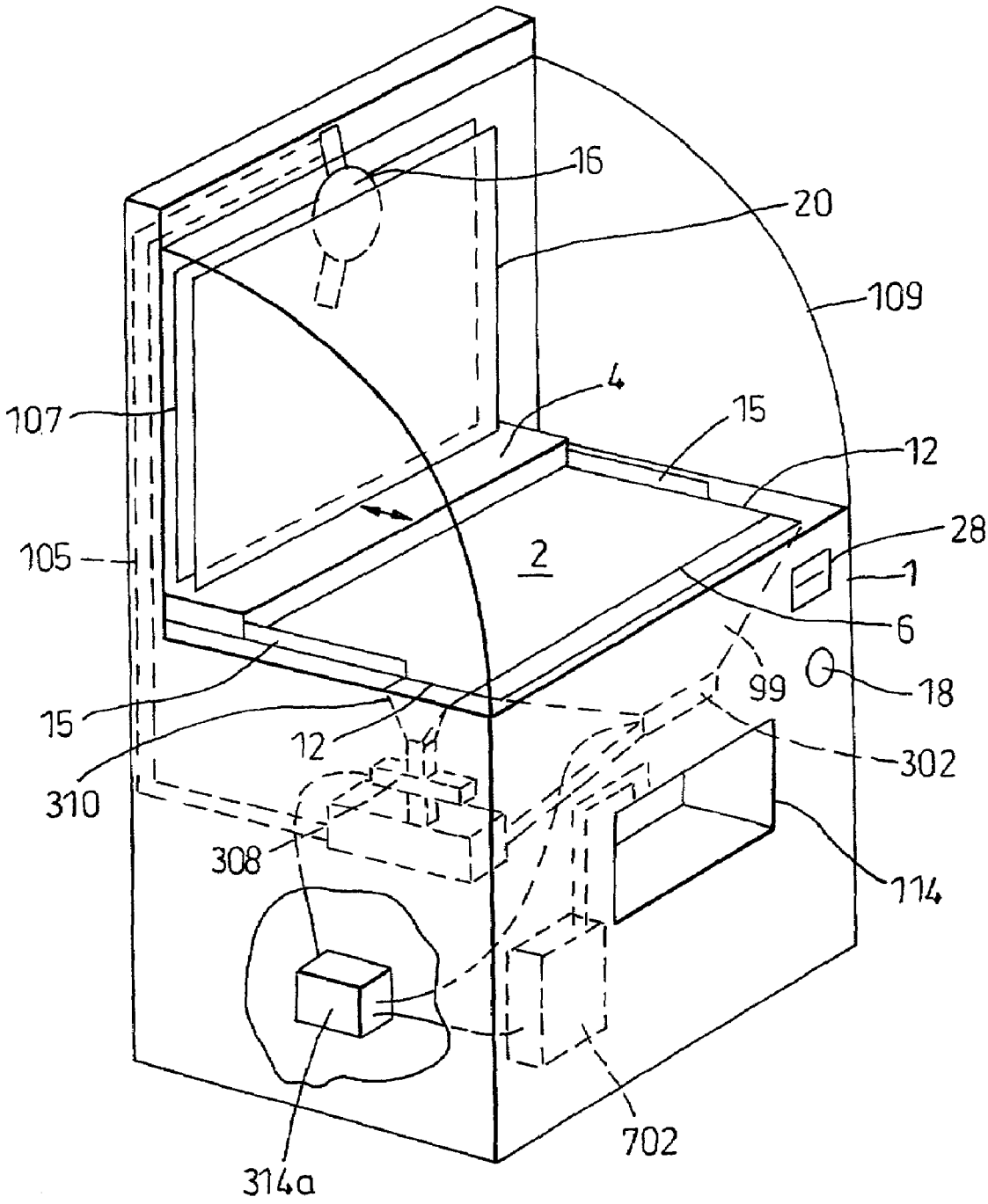

FIG. 27 shows a further embodiment. The pusher 1 further comprises a payout mechanism 702 capable of receiving signals from the controller 314*a*. The payout mechanism 702 is connected to the coin collection box 114 and coins may be passed from the payout mechanism 702 to the coin collection box 114.

In the embodiment of FIG. 27, the payout is controlled by the payout mechanism 702, which is in turn controlled by the controller 314*a*. When more than (for example) fifteen playing pieces fall from the surface at one time, the controller may alter the conversion rate between the number of playing pieces which fall from the surface and the value of the coins made available for collection from the coin collection box 114. For example, if each playing piece detected falling over the winning edge generally results in 10*p* being paid to the player, and the payout parameter is too high, each playing piece that falls from the playing surface as a group of more than fifteen may only result in 8*p* being paid to the player. Alternatively, a number of playing pieces may be discounted for the purposes of calculating the award to be paid. That is not all of the paying pieces falling from the playing surface are made available to the player, and the at least one variable against which the payout is controlled comprises money paid into the machine.

The skilled person will appreciate that any one machine may incorporate more than one of the payout controlling means of FIGS. 22 to 27. Further, although the machine is described as controlling the payout parameter it may simply control the rate of winnings payout, or rate of losses payout (i.e. the number of playing pieces that fall from a winning/losing edge in a predetermined period, which over the life of a machine is likely to be relatively constant whilst the machine is being played).

Other embodiments of the machine are known in which the playing pieces are coins, and the playing pieces that are fed into the slot 28 are paid directly to the player should they fall over the winning edge 6. The payout controlling means described herein would be equally applicable to such an open loop pusher.

Indeed, it is possible for the playing pieces on the playing surface to have different values. This may be achieved by marking at least one of the playing pieces with an RFID tag, which allows it to be identified, and given a different value. Such an embodiment would also be applicable to the payout controlling means described above. The skilled person would appreciate that the winning and losing playing piece counters 302, 308 would need to count the value of the playing pieces rather that the number of playing pieces.

The machine of FIG. 28, shown in greater detail in FIG. 29, is of the type known as a pusher and features in common with the pushers described herein before have been labelled with like numbers. In particular, it should be noted that the machine comprises a prize dispenser 110.

A further button 330 is provided to allow a player to cause the machine to make a cash payout rather than delivering a prize to a player.

The machine provides a coin slot 28, for providing payment which in this embodiment, is in the form of coins. The coin slot 28 is connected to a coin validator 104, which in turn is connected to a controller 314*c*.

The machine further provides a playing piece release button 18, which, when pressed, allows playing pieces to be released from directional playing piece dispenser 16. The playing piece release button 18 provides an input to the controller 314*c*.

Inside of the cabinet, there is further provided a tilt detection mechanism 115 of the type described herein before.

A display 324 is provided, driven by the controller 314*c*, and arranged to display the value of playing pieces that have fallen over the winning edge 6. The value shown on the display shows the value of a win bank maintained within a portion of the memory 118 of the controller 314*c*. Each playing piece is arranged to have a predetermined value, which can be different for different playing pieces. For instance, some of the playing pieces (RFID playing pieces) may contain radio frequency identification tags (RFID), or the like, which allow these playing pieces to be differentiated from the others. Such identifiable playing pieces are coloured differently from the others, so that a player can identify them on the playing surface. Such RFID tokens are disclosed in the British Patent application GB 0121651.4. The content of this application is hereby incorporated by reference, and the skilled person is directed to read this earlier application to understand such identifiable playing pieces. The RFID playing pieces have a higher value than the others, which value will be determined by the ratio of non-RFID playing pieces to RFID ones. For example, if there are ten times as many RFID playing pieces the RFID playing piece may be worth ten times more than the non-RFID playing piece.

A prize dispenser 110 is provided, as can be seen from FIG. 31, on the side of the machine and arranged to dispense a small container, containing a prize. At a top region 400 of the prize dispenser 110, at a convenient height for a user to view, there is provided a window 403 within a prize-dispensing flap. One of the prize containers can be seen through the window 403, providing an opportunity for a player to determine whether he/she wishes to be awarded the prize, and so providing an incentive to play the machine. Each of the prizes has clearly associated therewith the number of credits that are needed to win that prize. The prize dispenser 110 is controlled by the controller 314*c* and arranged to dispense the containers through the prize-dispensing flap.

The prize dispenser 110 is a unit attached to the side of the machine. As can be seen from FIGS. 31 and 32, within the dispenser 110, there is a stack 402 of containers 406, each of which contains a prize. In this embodiment the containers 406 are cardboard boxes. A crank 404 driven by an electric motor can be activated to push the upper most container 406 from the stack out through the prize-dispensing flap of the prize dispenser 110. Once a prize has been dispensed the crank 404 is retracted, allowing the stack of containers to be raised so that the process can be repeated the next time that it is desired to dispense a prize. A pulley mechanism 408 within the dispenser 110 allows the stack 402 to be raised and also provides a guiding function ensuring that the containers remain stacked on top of one another. The prize-dispensing flap has a mechanism to ensure that a player cannot reach inside and remove a container, unless it is pushed out by the crank 404.

Further, a prize dispense request input means 326 is provided on the front of the machine, and provides an input to the controller 314*c*, allowing a player to select a prize from the prize dispenser 110.

In use, a player inserts one or more coins into the coin slot 28 until a desired total payment is made. This will determine the number of playing pieces that can be released from the directional coin dispenser 16 by pressing the playing piece release button 18. Once the player presses the playing piece release button 18 playing piece are released from the directional coin dispenser 16 into the transparent region 20 and onto the playing surface 2 (as long as the player has sufficient credits). The playing piece release button 18 is connected to the controller 314*c*, which has determined how may coins have been inserted into the coin slot 28 through its connection to the coin validator 104. Thus, the controller only causes the dispenser 16 to release playing pieces if the player has sufficient credit.

One, or more, playing pieces are released onto the playing surface 2 in the hope that the action of the playing piece pusher 4 on that playing pieces, and on the body of playing pieces already dispersed on the playing surface 2, will cause one or more playing pieces to fall from the winning edge 6 of the playing surface 2 into the win chute 99. Playing pieces which fall into the win chute 99 are counted by the counter 102. The number of playing pieces counted by the counter 102 is used to calculate an award, such as a cash equivalent of the playing pieces, or a prize, which will form a part of a payout to the player.

Once the playing pieces have been counted, they will be transferred to the escalator 105, ready for reuse in the machine, by recirculation to the dispenser 16.

In normal use, the player continues to press the playing piece release button 18 until no more playing pieces will be released from the directional playing piece dispenser 16. The player may then either insert more coins into the coin slot 28, or may collect his/her winnings, if any, from the payout collection box 114, or cause the prize dispensing means 110 to dispense a prize.

The counter 102 counts playing pieces that have fallen from the playing surface 2, and also detects any RFID tokens within these playing pieces. A signal containing the number of playing pieces and the number of RFID playing pieces is fed to the controller 314*c*, which updates the display 324. In the embodiment shown it can be seen that a player has caused playing pieces having a value of forty credits to fall into the win chute 99.

The player can view an example of a prize through the window 403, and see prizes that are on offer. The value, in credits, of each of the prizes in the prize dispensing means is shown thereon, or on a container containing the prize, and once the player has accumulated enough credits they can cause the prize dispenser 110 to dispense a prize from the prize dispenser 110, by activating the prize dispense request input means 326. A single prize dispensing means may pay out a single type of prize, or may contain a variety of prizes. Some embodiments of the machine may be provided with a number of prize dispensing means, each dispensing one prize, which may be different from prizes in the other prize dispensers. The player may decide that they wish to receive a cash award from the machine rather than a prize, in which case they may press the button 330 to cause a cash prize to be paid to the payout collection box 114 from the coin store 32.

Although the prize selection input means 326 is simply a button in this embodiment, the skilled person will appreciate that more complex selection mechanisms may be provided.

For example, FIG. 30 shows a selector, which in this case, comprises an LCD screen 350 that is touch sensitive. The prizes that are left within the machine are displayed pictorially 352 (In this case a watch is displayed). The picture of the prize 352 is accompanied by the number of credits that a player must accumulate to win that prize 354.

At a bottom region of the selector backward 356, and forward 358 scroll input regions are provided, allowing a player to scroll through the available prizes by touching that region of the selector. Further, a select input region 360 is provided, which a player can touch should he/she wish to be given the prize displayed (assuming of course they have enough credits in the win bank).

In some embodiments the machine may be arranged to award a prize if a predetermined event occurs. For example, if an RFID token, or the like, were to fall from the playing surface over the winning edge.

The invention claimed is:

1. A pusher-type entertainment machine comprising a surface arranged to support playing pieces including first playing piece and at least one second playing piece wherein said at least one second playing piece is discernible from said at least one first playing piece, said surface having at least one edge over which playing pieces pass, and a playing piece detection means arranged to detect at least first playing pieces within said playing pieces passing over the at least one edge of said surface and further arranged to distinguish between the first playing pieces and the second playing pieces passing over the at least one edge of said surface.

2. The machine according to claim 1 which further comprises at least one prize dispensing means arranged to dispense a first prize when said playing piece detection means detects a predetermined number of said first playing pieces passing over the at least one edge of said surface.

3. The machine according to claim 2 in which said at least one prize dispensing means is arranged to dispense a second prize when said playing piece detection means detects a predetermined number of said second playing pieces passing over the at least one edge of said surface.

4. The machine according to claim 1 in which said playing piece detection means is arranged to monitor at least one of the following properties of playing pieces passing over the at least one edge of said surface: colour of said playing pieces, material from which said playing pieces are constructed, presence of a tag associated with said playing pieces, dimensions of said playing pieces.

5. A pusher-type entertainment machine containing at least a plurality of first and a plurality of second playing pieces discernible from one another, said machine comprising a surface arranged to support said first and said second playing pieces and having an edge over which playing pieces pass and a playing piece detection means arranged to detect at least said first playing pieces within playing pieces passing over the edge of said surface and further arranged to distinguish between the first playing pieces and the second playing pieces passing over the at least one edge of said surface.

6. The machine according to claim 5 in which said playing piece detection means is arranged to detect said second playing pieces within playing pieces passing over the at least one edge of said surface.

7. The machine according to claim 6 which further comprises a prize dispensing means arranged to dispense a first level of prize when the playing piece detection means detects a predetermined number of said first playing pieces, and a second level of prize when the playing piece detection means detects a predetermined number of said second playing pieces.

8. A method for increasing player appeal of a pusher-type entertainment machine comprising the steps of providing a surface arranged to support at least one playing piece, said surface having at least one edge over which playing pieces pass, providing at least one first and at least one second playing piece, wherein said at least one first playing piece is discernible from said at least one second playing piece and said method further comprises detecting at least said first playing pieces within said playing pieces passing over the at least one edge of said surface and distinguishing between the first playing pieces and the second playing pieces passing over the at least one edge of said surface.

9. The method of claim 8 which further comprises providing further types of playing pieces in addition to said at least one first and at least one second playing pieces, identifying the type of playing piece and providing a prize dispenser which dispenses a predetermined level of prize for each type of playing piece passing over the at least one edge of said surface.

* * * * *